US012232626B2

(12) United States Patent
Alletto, Jr.

(10) Patent No.: US 12,232,626 B2
(45) Date of Patent: Feb. 25, 2025

(54) BEDDING SYSTEM, KIT AND METHOD

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 18/450,186

(22) Filed: Aug. 15, 2023

(65) Prior Publication Data

US 2023/0389712 A1 Dec. 7, 2023

Related U.S. Application Data

(63) Continuation of application No. 16/748,128, filed on Jan. 21, 2020, now Pat. No. 11,723,475.

(Continued)

(51) Int. Cl.
*A47C 27/07* (2006.01)
*A47C 27/00* (2006.01)

(Continued)

(52) U.S. Cl.
CPC ..... *A47C 27/05* (2013.01); *A47C 27/001* (2013.01); *A47C 27/002* (2013.01); *A47C 27/14* (2013.01)

(58) Field of Classification Search
CPC ..... A47C 23/007; A47C 23/002; A47C 23/00; A47C 27/14; A47C 27/066; A47C 27/062;

(Continued)

(56) References Cited

U.S. PATENT DOCUMENTS 3,530,487 A * 9/1970 Beer ..... A47G 9/02 5/500
5,564,141 A * 10/1996 Anderson ..... A47C 27/085 5/678

(Continued)

FOREIGN PATENT DOCUMENTS

DE 202012008239 U1 10/2012
WO 2016018703 A1 2/2016

OTHER PUBLICATIONS

Savvy Rest, How to assemble your Savvy Rest SerenitySpring Mattress, Jun. 13, 2017, YouTube, https://www.youtube.com/watch?v=3bb_WWgkqf8 (Year: 2017).*

(Continued)

*Primary Examiner* — Justin C Mikowski
*Assistant Examiner* — Ifeolu A Adeboyejo
(74) *Attorney, Agent, or Firm* — Sorell, Lenna & Schmidt, LLP

(57) ABSTRACT

A bedding system includes a chassis having a bottom wall, opposite first and second side walls extending upwardly from the bottom wall and opposite first and second end walls extending upwardly from the bottom wall. The walls define a cavity. A coil pack is positioned in the cavity. The coil pack includes a plurality of springs. A first cover is positioned over the coil pack. The first cover is attached to the chassis by a first zipper. A comfort layer is positioned over the first cover. The comfort layer is attached to the chassis by a second zipper. A second cover is positioned over the comfort layer. The second cover is attached to the chassis by a third zipper. In some embodiments, kits and method of use are disclosed.

20 Claims, 34 Drawing Sheets

Related U.S. Application Data

(60) Provisional application No. 62/796,330, filed on Jan. 24, 2019.

(51) Int. Cl.
*A47C 27/05* (2006.01)
*A47C 27/14* (2006.01)

(58) Field of Classification Search
CPC ..... A47C 27/06; A47C 27/07; A47C 27/001; A47C 27/053; A47C 27/05; A47C 27/00
See application file for complete search history.

(56) References Cited

U.S. PATENT DOCUMENTS

| | | | | |
|---|---|---|---|---|
| 2007/0283501 | A1* | 12/2007 | Mossbeck | A47C 27/00 5/690 |
| 2010/0287707 | A1* | 11/2010 | Beard | A47C 27/081 5/706 |
| 2017/0035211 | A1* | 2/2017 | Alletto, Jr. | A47C 27/001 |
| 2017/0156508 | A1* | 6/2017 | Segal | A47C 27/001 |
| 2019/0328150 | A1* | 10/2019 | Nolte | A47C 27/15 |
| 2019/0333127 | A1* | 10/2019 | Nolte | A47C 31/105 |

OTHER PUBLICATIONS

WO2020154372 Written Opinion of the International Searching Authority, International Search Report dated Jul. 30, 2020.

* cited by examiner

Step 2 | Open BOX 2 - Independent Suspension

1. The independent suspension (coil packs) will be marked with the comfort choice you purchased.

2. Lift coil pack from box and place inside open chassis

3. Using cutting tool, remove outer plastic sleeve, allowing coil to decompress

4. Make small incision to inner plastic cover, allowing coils to decompress.
Continue to cut slowly- coils will expand 5. If you have two coil packs, position first pack to the appropriate side. Repeat process with second set of coils, if applicable. Once coil packs are in place, place Air-X Top Cover (attached to chassis) over coils and zip close.

Note: Zippers should not meet in the center at the foot of the bed.

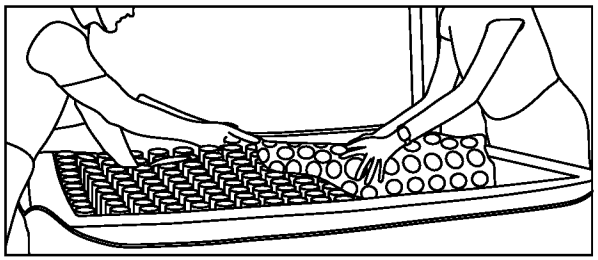

The left and right comfort choice identification will be labeled on delivery slip, invoice or order specific for each retailer

154

FIG. 22

Step 3| Open BOX 3 - Comfort Layer

1. Remove Comfort Layer from box and place on the top of the assembled chassis and independent suspension unit(s).

2. Using cutting tool, remove plastic outer sleeve, allowing Comfort Layer to unroll.

3. Once unrolled, use cutting tool to pierce the inner compression sleeve.
This will open the Comfort Layer.

4. Zipper start on Comfort Layer should be positioned at head end of the bed in order to connect to chassis. If necessary, rotate Comfort Layer to correct position Zip to chassis.

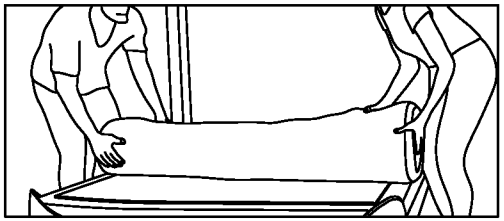

Zipper should be facing down, with zipper start positioned at the head end.

154

FIG. 23

BEDDING SYSTEM, KIT AND METHOD

CROSS-REFERENCE TO RELATED APPLICATIONS

This application is a continuation application of U.S. patent application Ser. No. 16/748,128, filed on Jan. 21, 2020, which claims priority to U.S. Provisional Patent Application Ser. No. 62/796,330, filed on Jan. 24, 2019. These applications are expressly incorporated by reference herein, in their entireties.

TECHNICAL FIELD

The present disclosure generally relates to bedding, and more particularly to bedding systems that are modular and configured to be personalized based on comfort choices and that includes individual components that can be upgraded and/or replaced.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

Two popular mattress choices currently available are spring mattresses and foam mattresses. However, because foam mattresses consist of a foam, such as, for example, memory foam, such foam mattresses are typically not sturdy enough to provide proper support to a sleeper's body. Foam mattresses also lack the ability to clean within the foam mattress or replace components of the foam mattress over time. For example, if the sleeper's desired comfort choice changes over time, he or she will be required to purchase a completely new foam mattress to accommodate the user's new comfort choice. Spring mattresses are typically pre-assembled and are shipped to a destination as freight due to the size of the spring mattress. That is, most spring mattresses cannot be shipped by ground delivery because the spring mattresses each exceed the size permitted for ground delivery. Moreover, because spring mattresses are typically pre-assembled, spring mattresses lack the ability to clean within the spring mattress or replace components of the spring mattress over time. For example, if the springs of the spring mattress wear out, the sleeper will be required to purchase a completely new spring mattress. This disclosure describes an improvement over these prior art technologies.

SUMMARY

In one embodiment, in accordance with the principles of the present disclosure, a bedding system is provided that includes a chassis comprising a bottom wall, opposite first and second side walls extending upwardly from the bottom wall and opposite first and second end walls extending upwardly from the bottom wall. The walls define a cavity. A coil pack is positioned in the cavity. The coil pack comprises a plurality of springs. A first cover is positioned over the coil pack. The first cover is attached to the chassis by a first zipper. A comfort layer is positioned over the first cover. The comfort layer is attached to the chassis by a second zipper. A second cover is positioned over the comfort layer. The second cover is attached to the chassis by a third zipper.

In one embodiment, in accordance with the principles of the present disclosure, a bedding kit is provided that includes a chassis comprising a bottom wall, opposite first and second side walls extending upwardly from the bottom wall and opposite first and second end walls extending upwardly from the bottom wall. The walls define a cavity. A coil pack is configured to be positioned in the cavity. The coil pack comprises a plurality of springs. A first cover is configured to be positioned over the coil pack. The first cover is configured to be attached to the chassis by a first zipper. A comfort layer is configured to be positioned over the first cover. The comfort layer is configured to be attached to the chassis by a second zipper. A second cover is configured to be positioned over the comfort layer. The second cover is configured to be attached to the chassis by a third zipper.

In one embodiment, in accordance with the principles of the present disclosure, a method of assembling a bedding system is provided. The method comprises: positioning a coil pack in a cavity of a chassis, the chassis comprising a bottom wall, opposite first and second side walls extending upwardly from the bottom wall and opposite first and second end walls extending upwardly from the bottom wall, the walls defining a cavity, the coil pack comprising a plurality of springs; positioning a first cover over the coil pack and attaching the first cover to the chassis with a first zipper; positioning a comfort layer over the first cover and attaching the comfort layer to the chassis using a second zipper; and positioning a second cover over the comfort layer and attaching the second cover to the chassis using a third zipper.

BRIEF DESCRIPTION OF THE DRAWINGS

The present disclosure will become more readily apparent from the specific description accompanied by the following drawings, in which.

Figure 1:
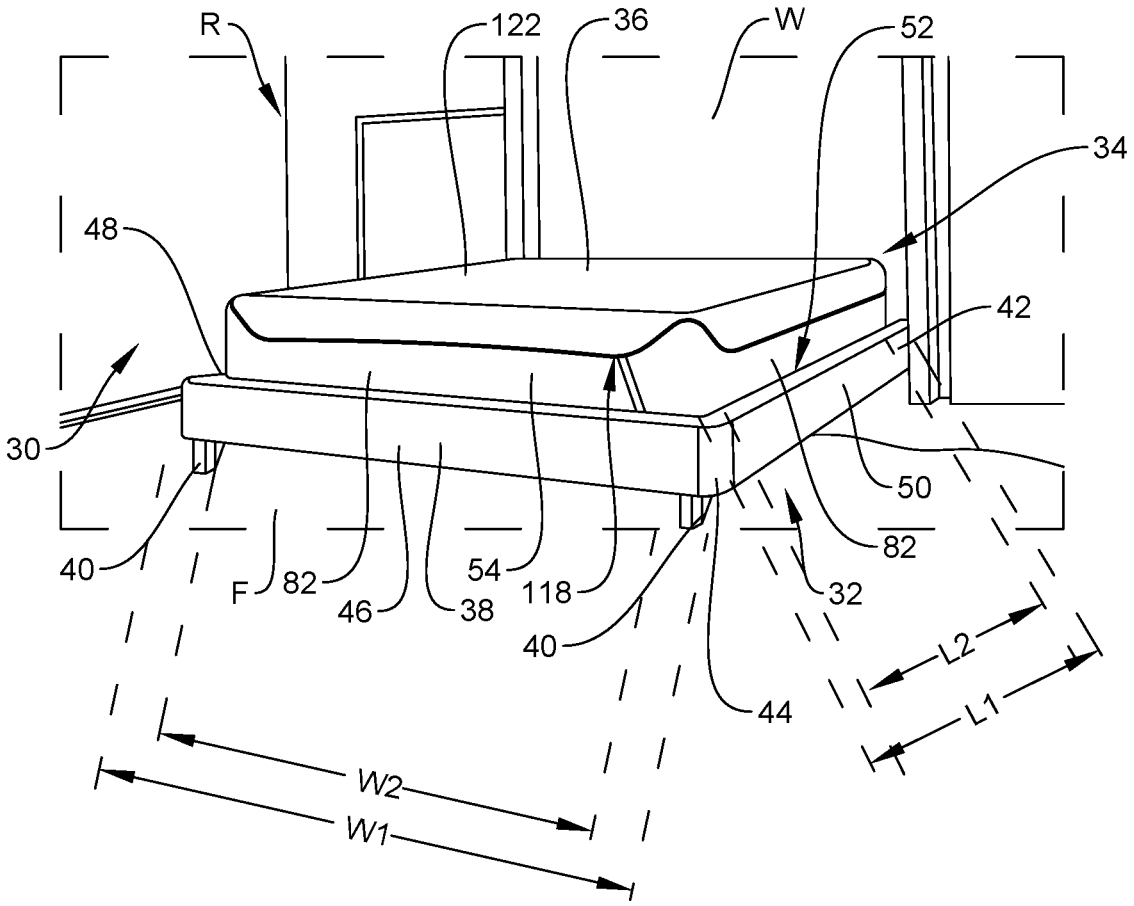
FIG. 1 is a perspective view of a bedding system in accordance with the principles of the present disclosure.
Figure 2:
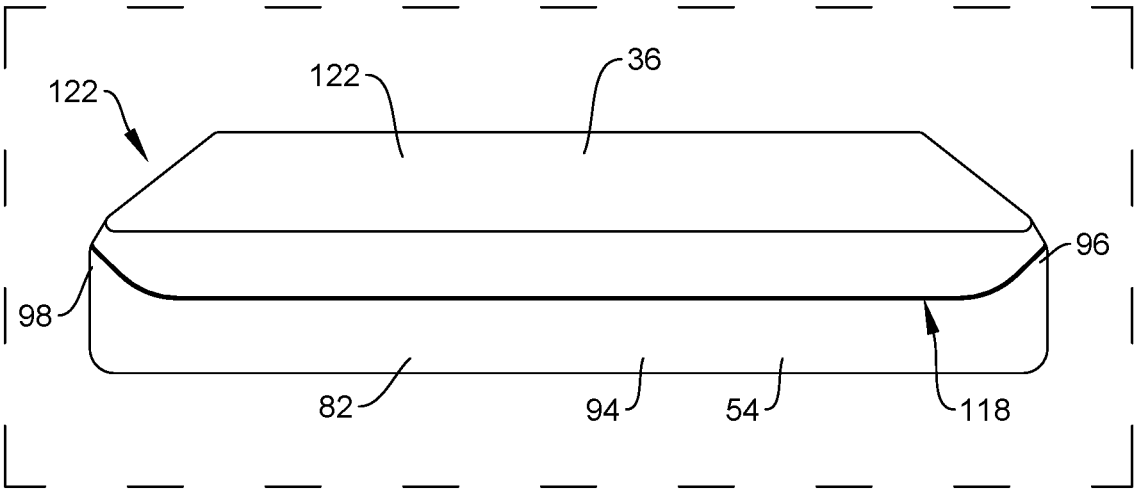
FIG. 2 is a perspective view of components of the bedding system shown in FIG. 1.
Figure 3:
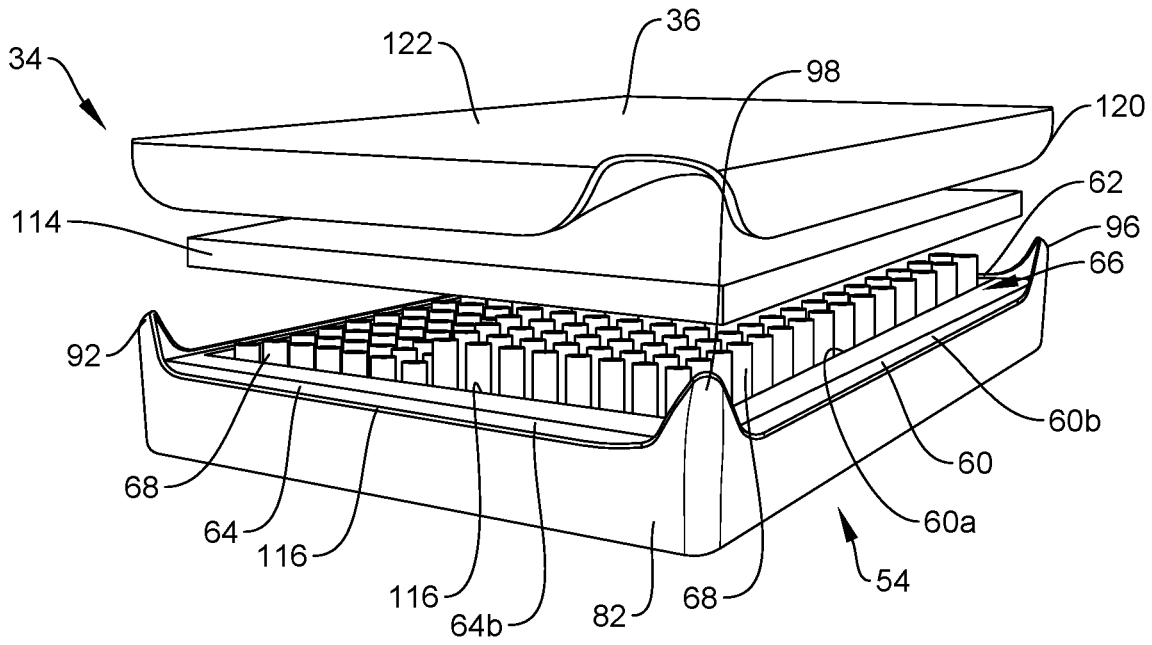
FIG. 3 is a perspective view of components of the bedding system shown in FIG. 1, with part separated.
Figure 5:
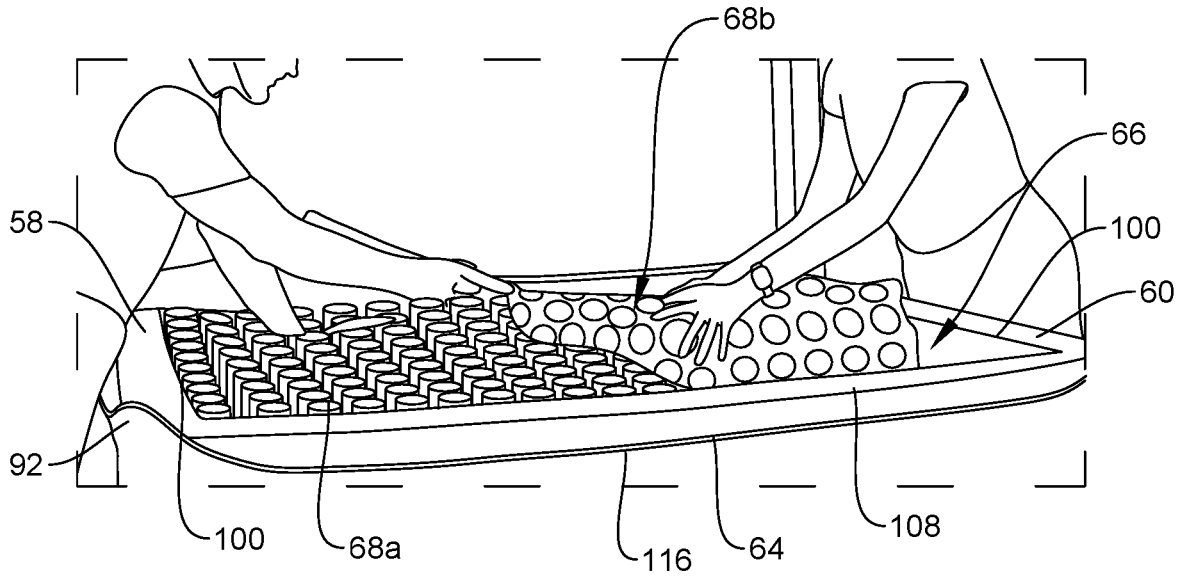
Figure 5A:
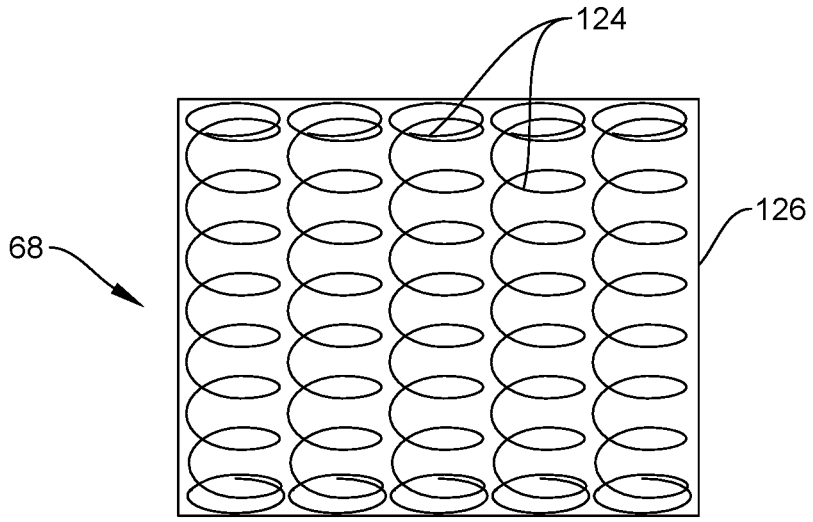
Figure 5B:
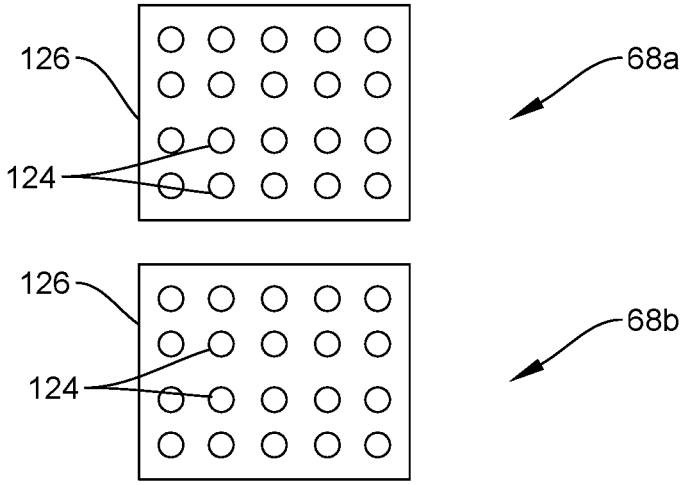
Figure 6:
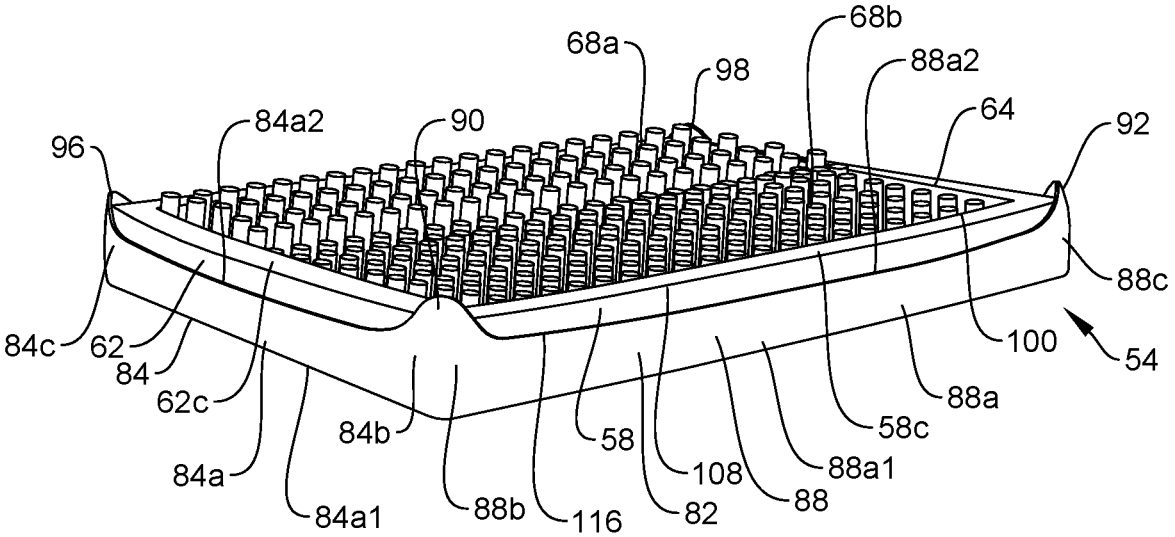
Figure 7:
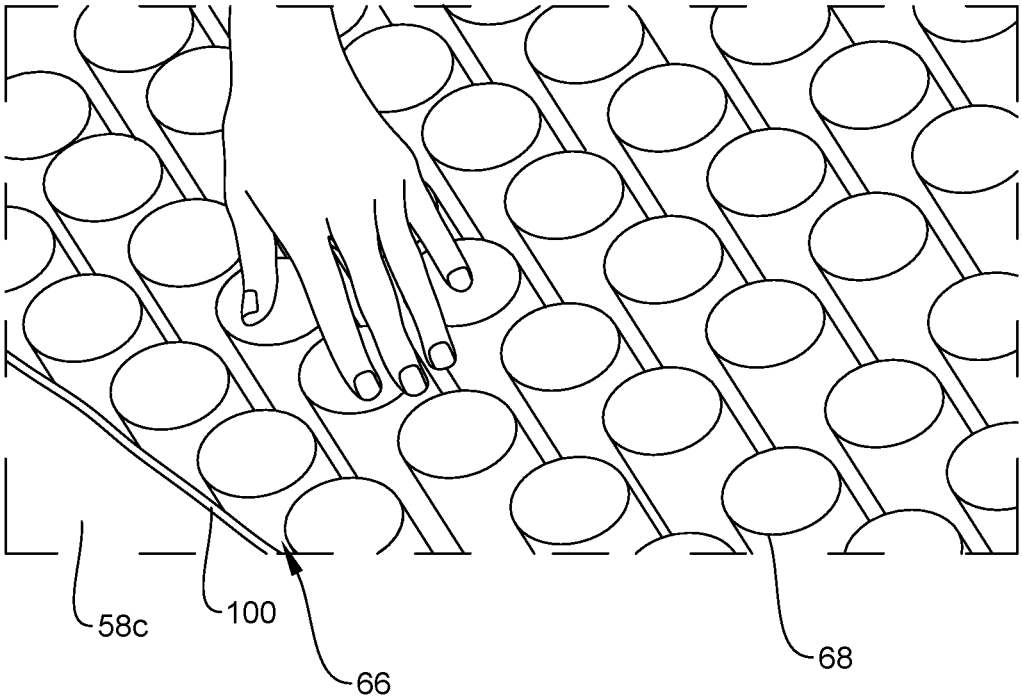
Figure 8:
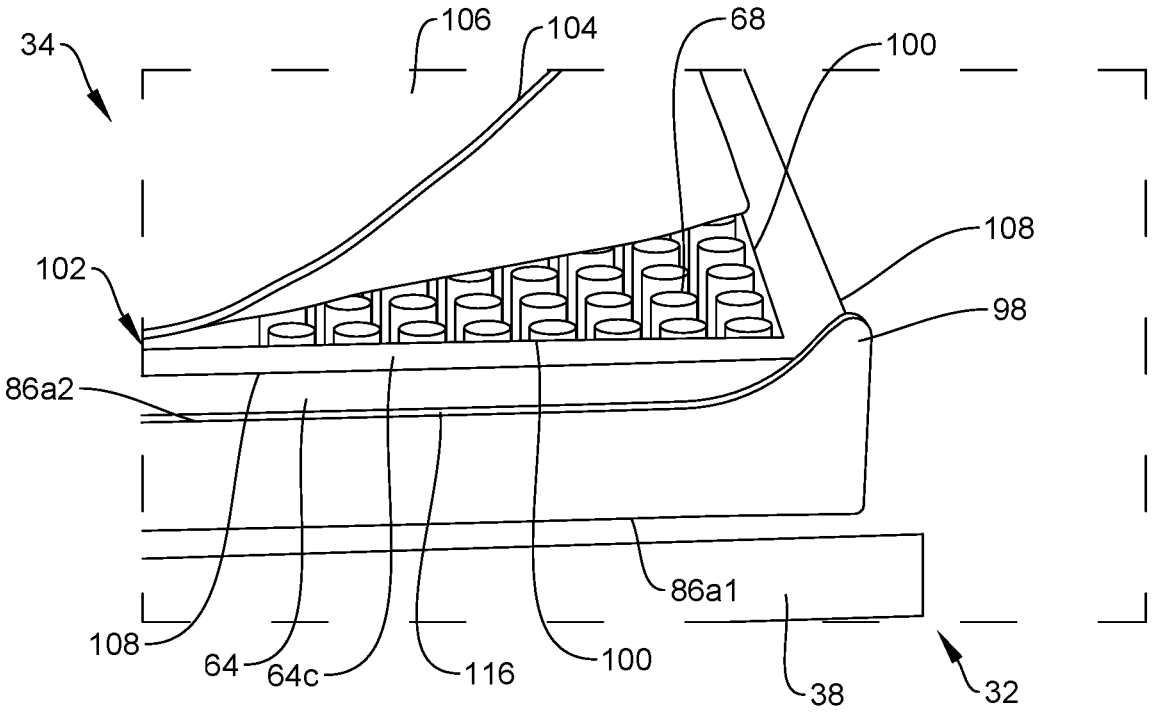
Figure 9:
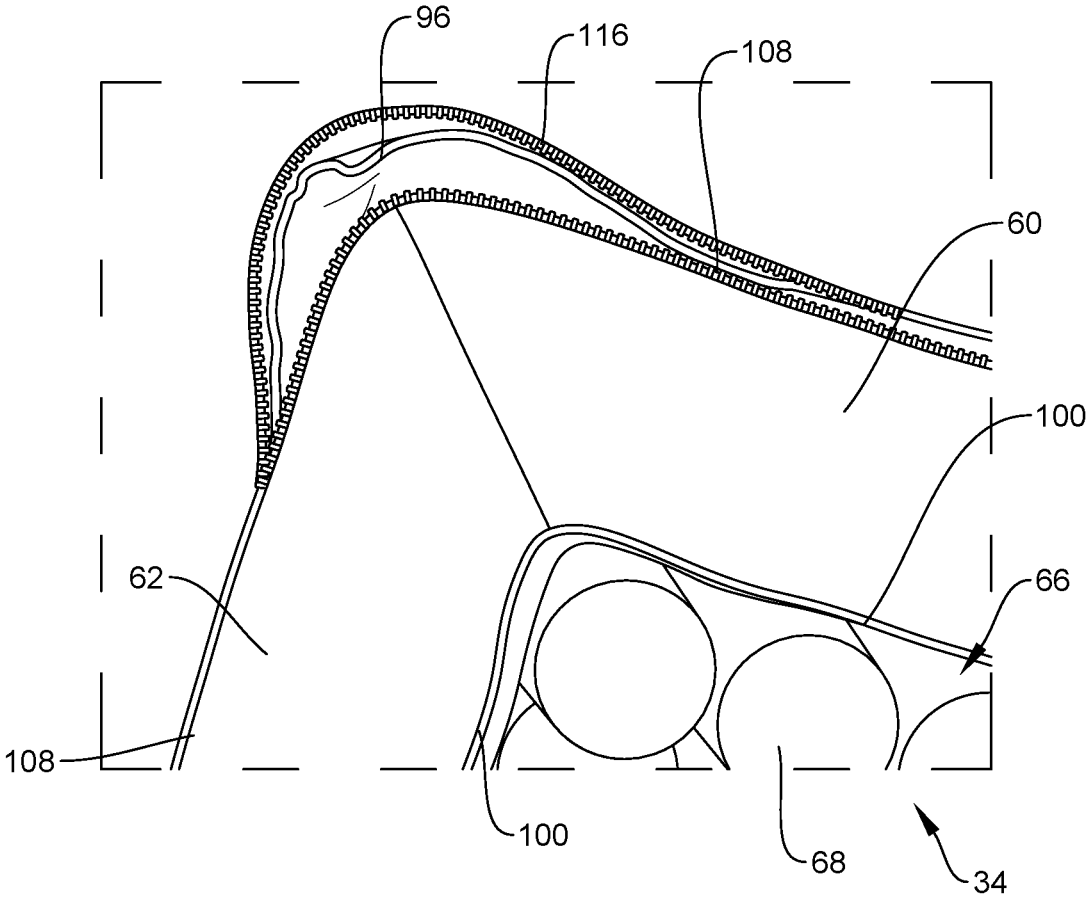
Figure 10:
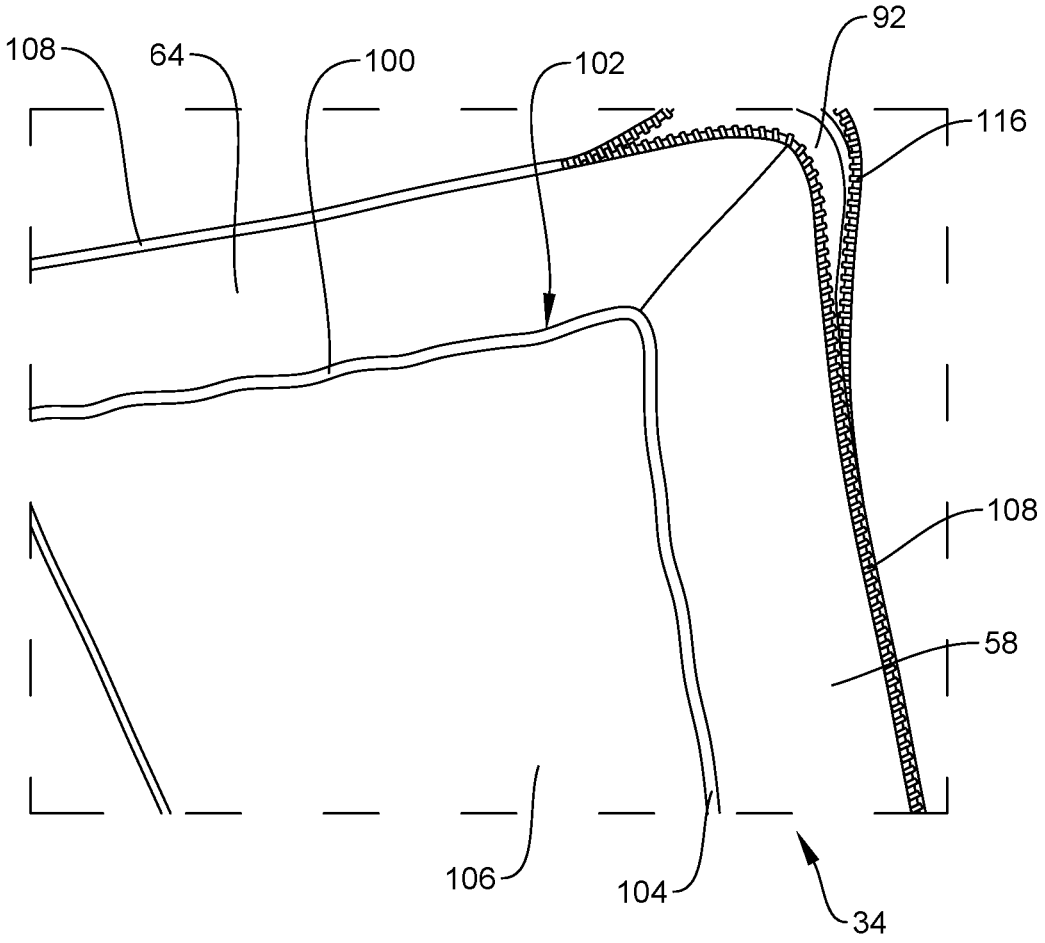
Figure 10A:
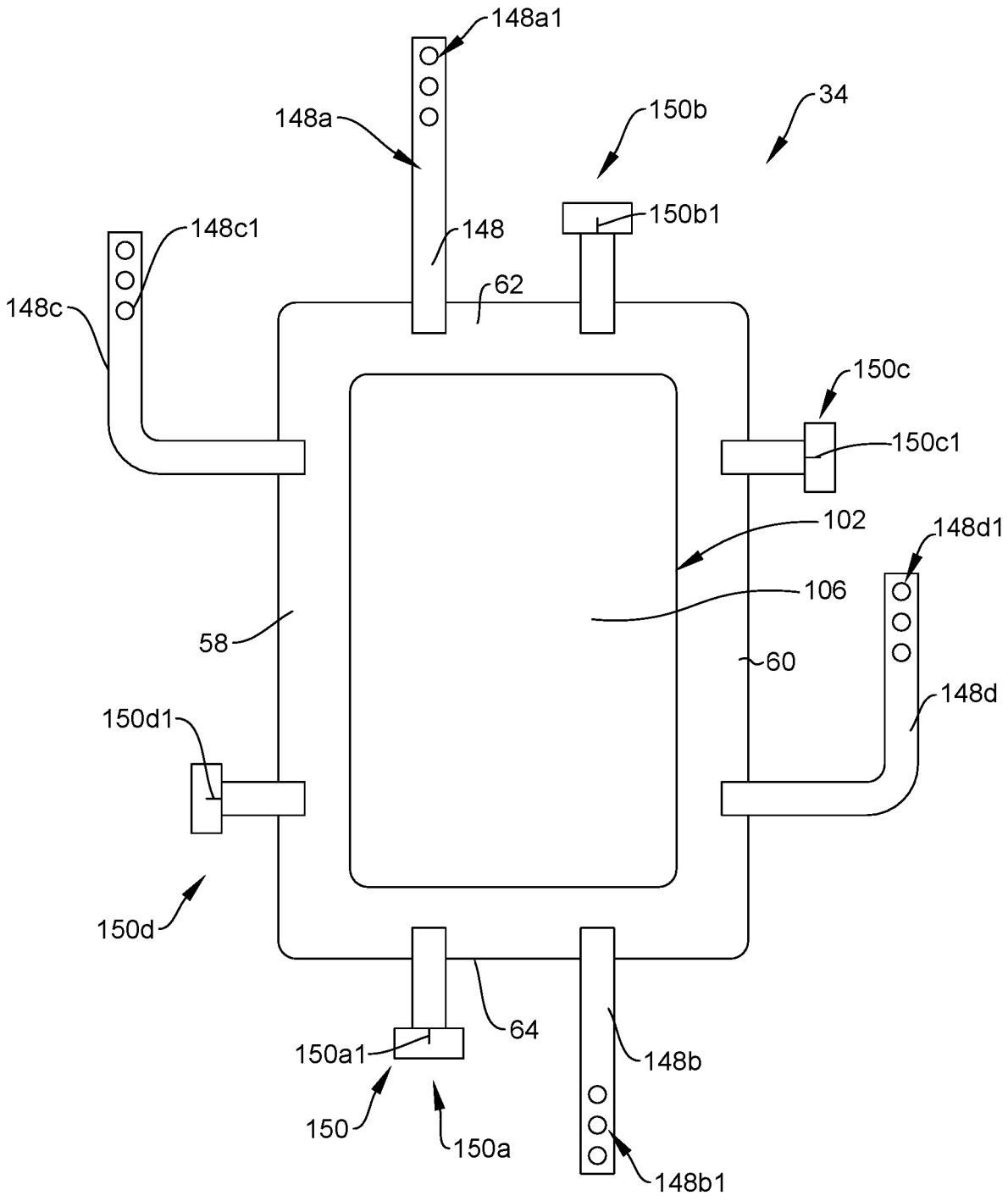
Figure 11:
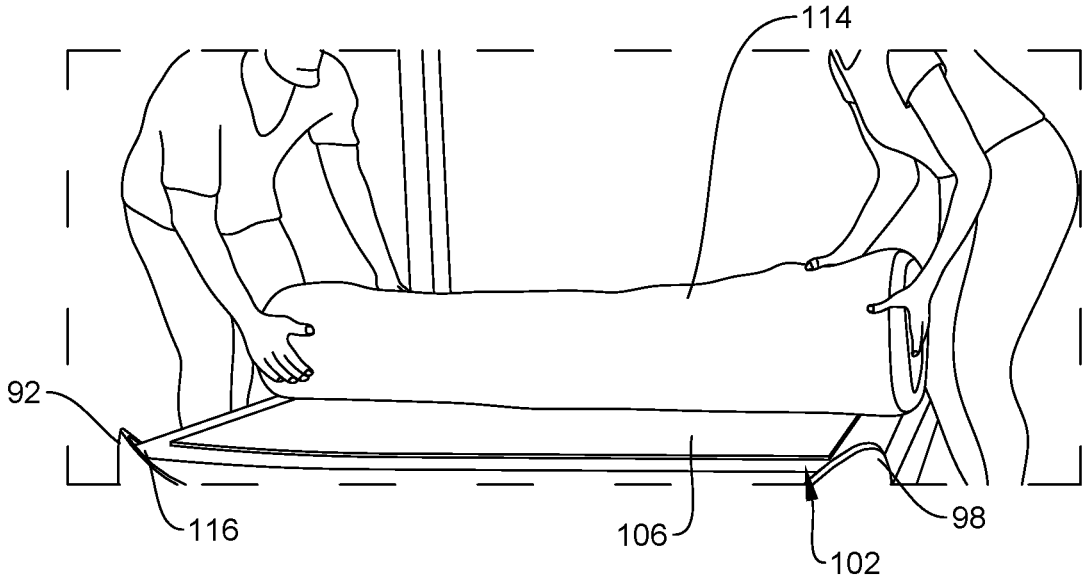
Figure 12:
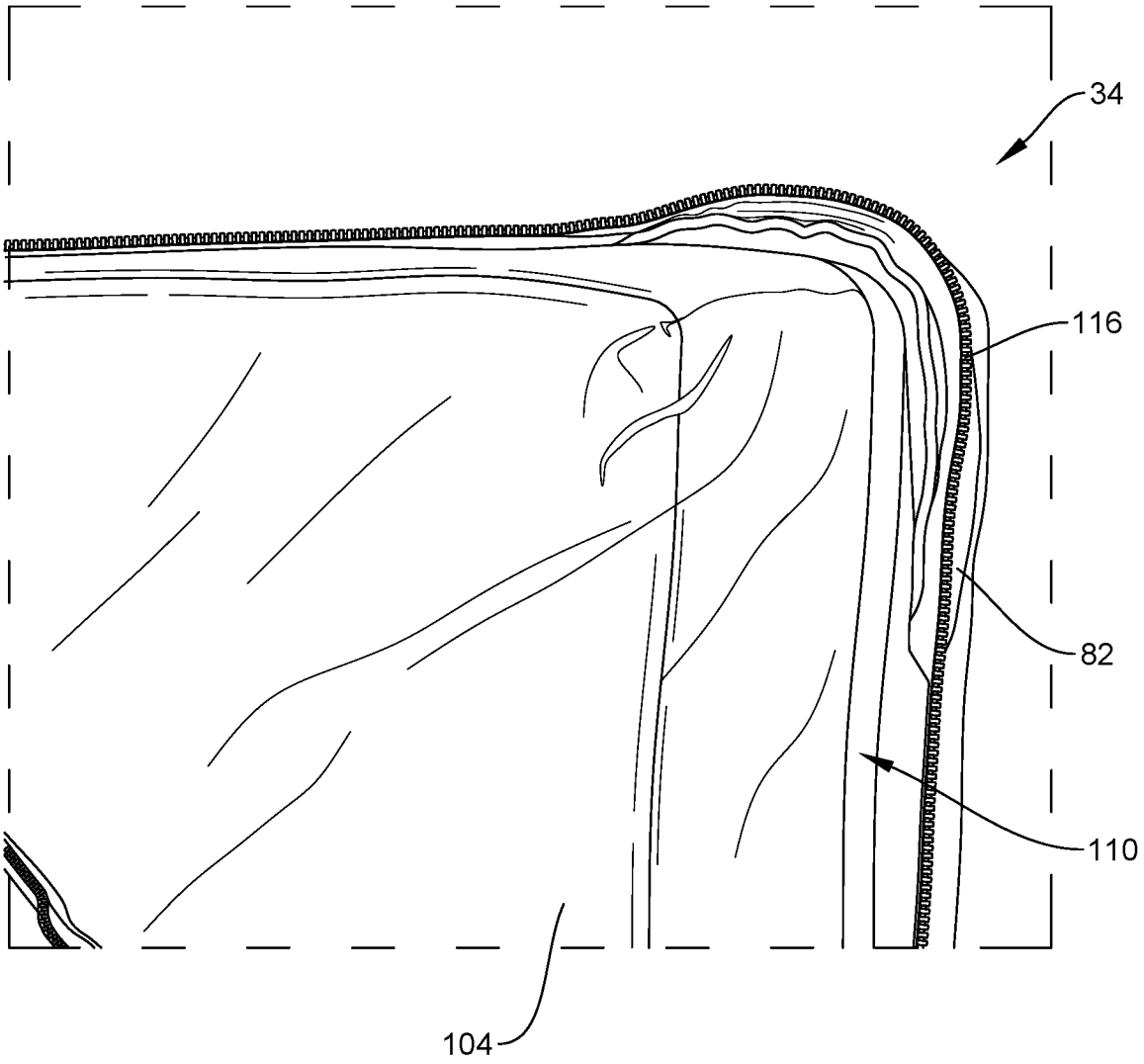
Figure 13:
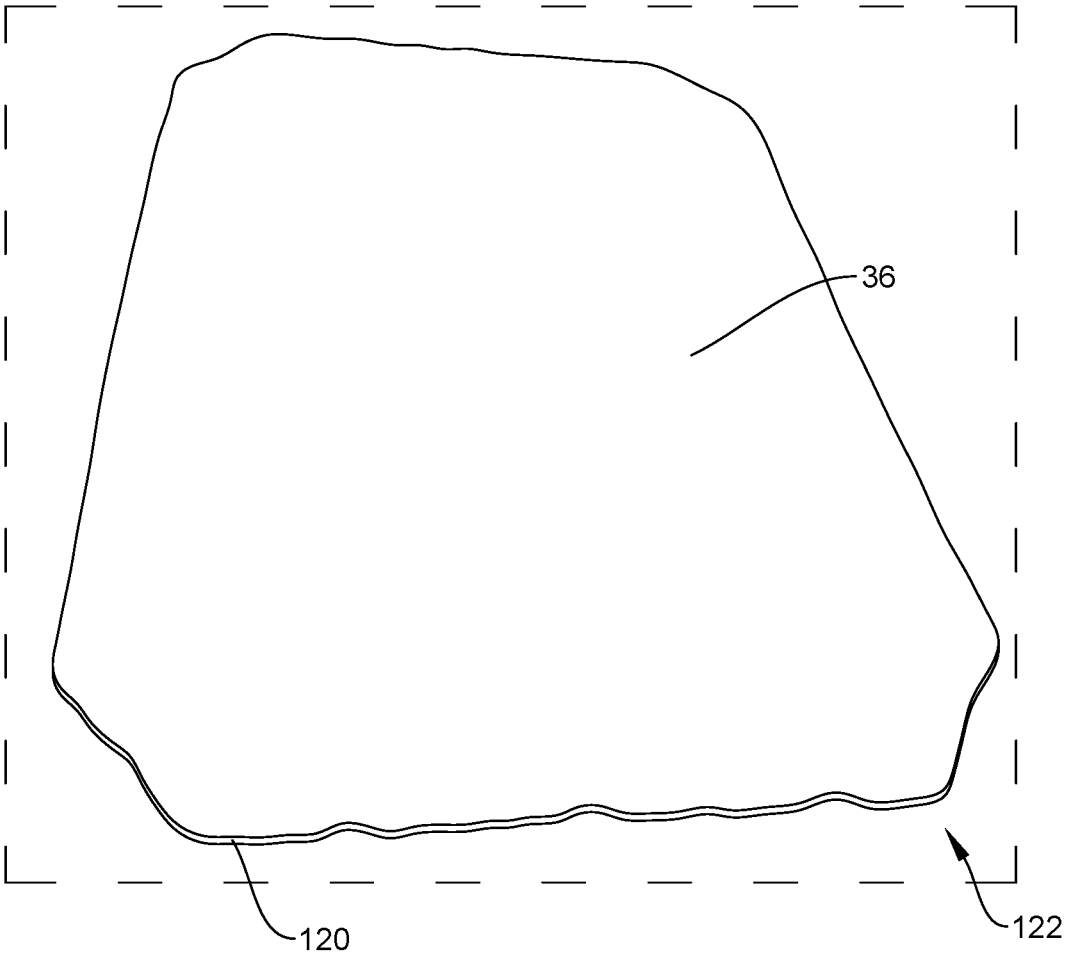
Figure 13A:
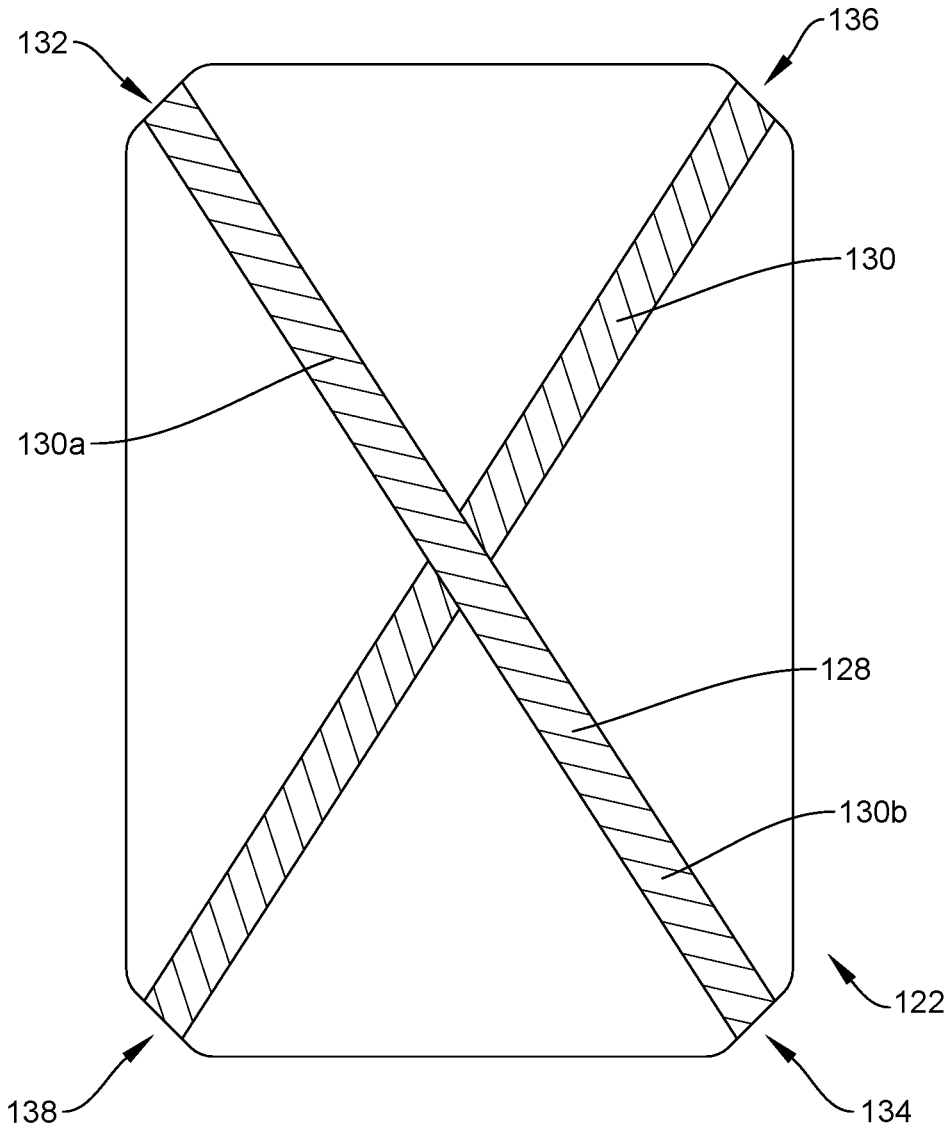
Figure 13B:
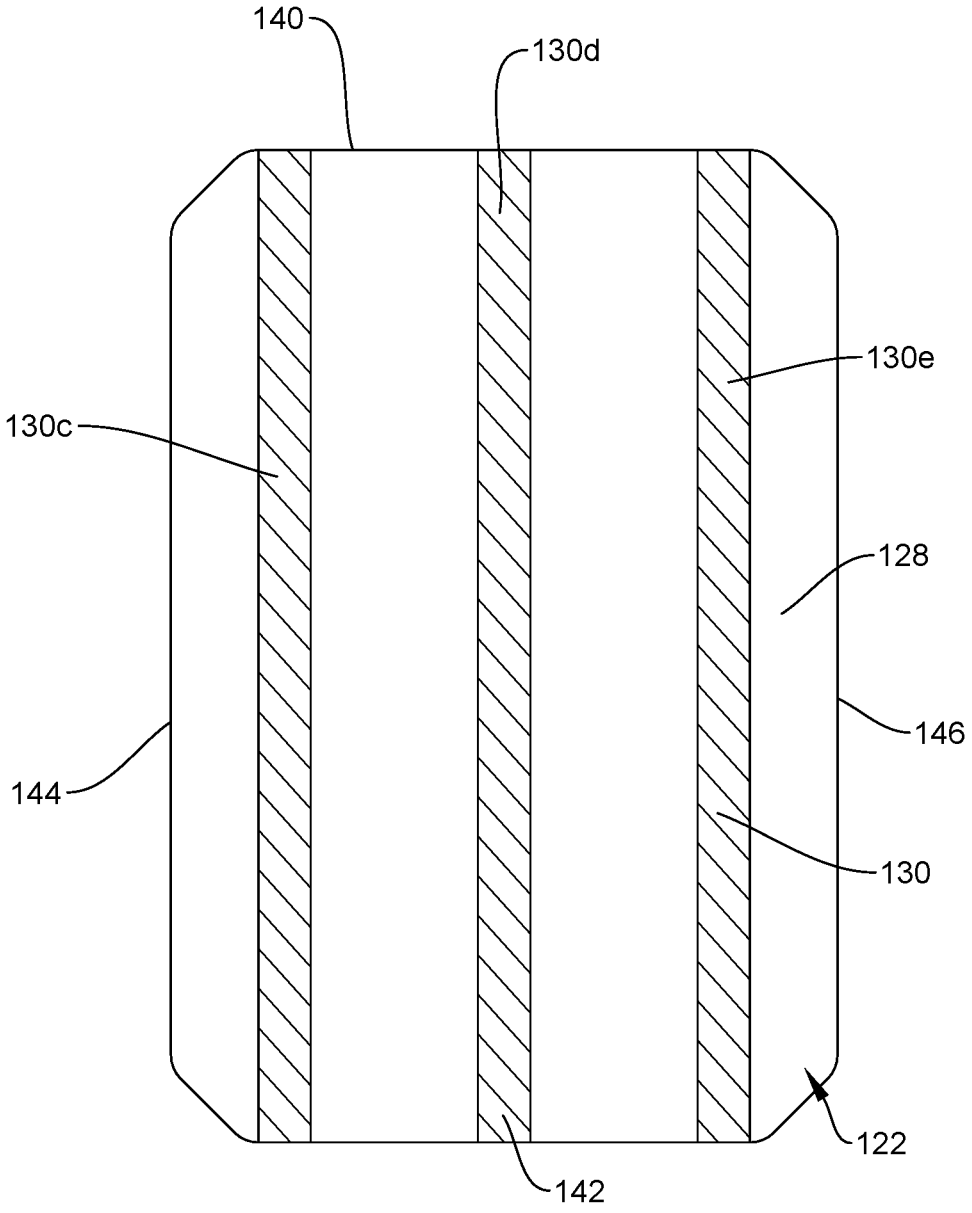
Figure 13C:
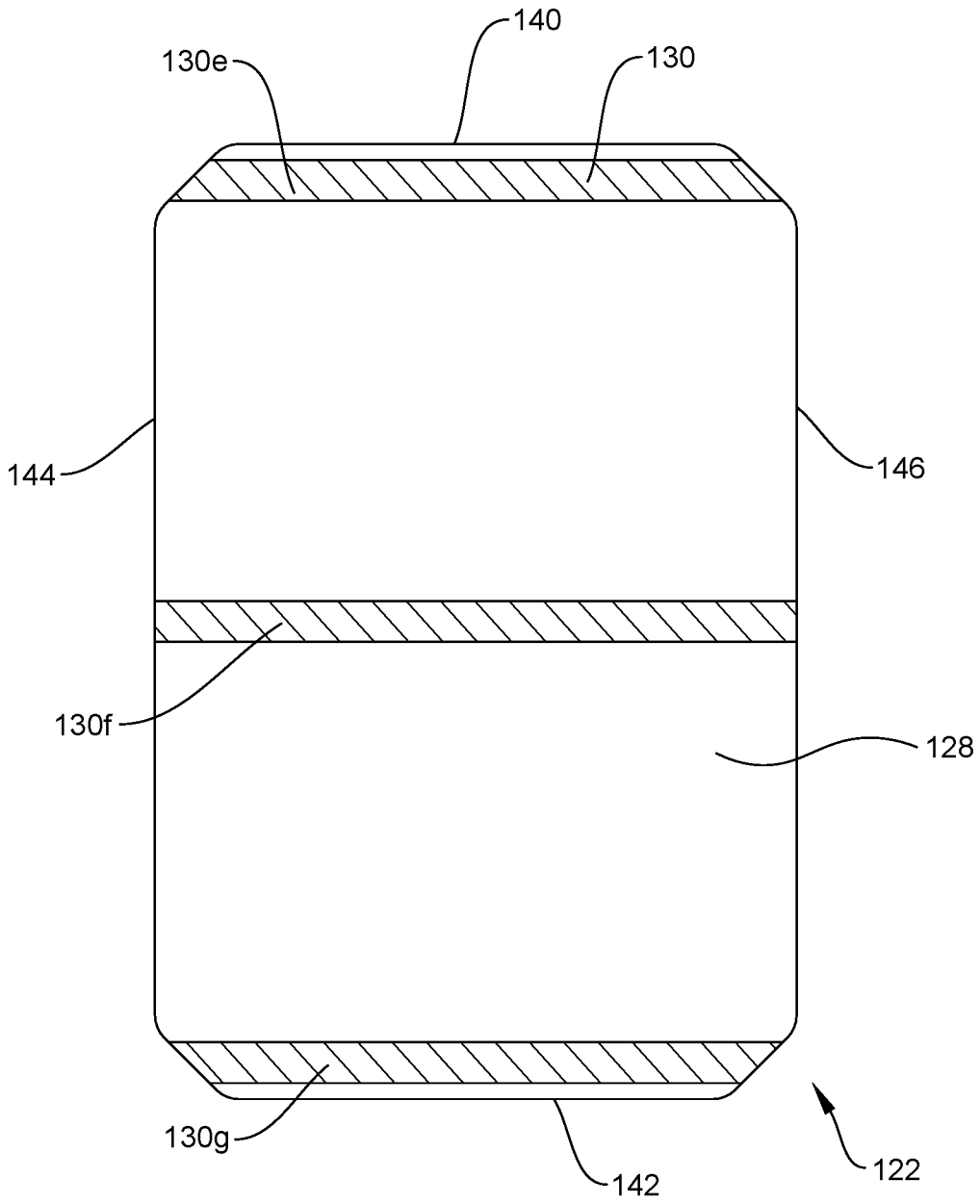
Figure 14:
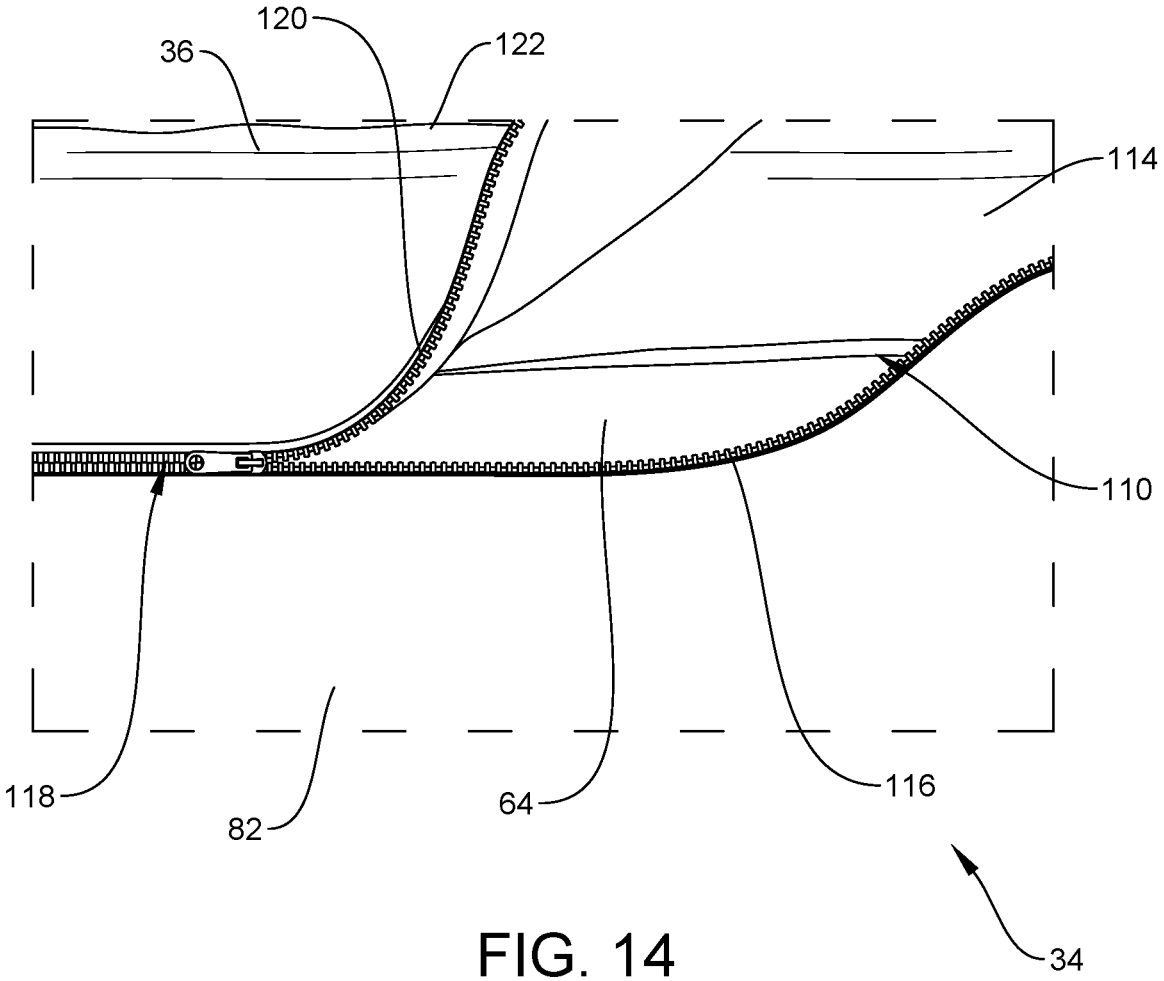
Figure 15:
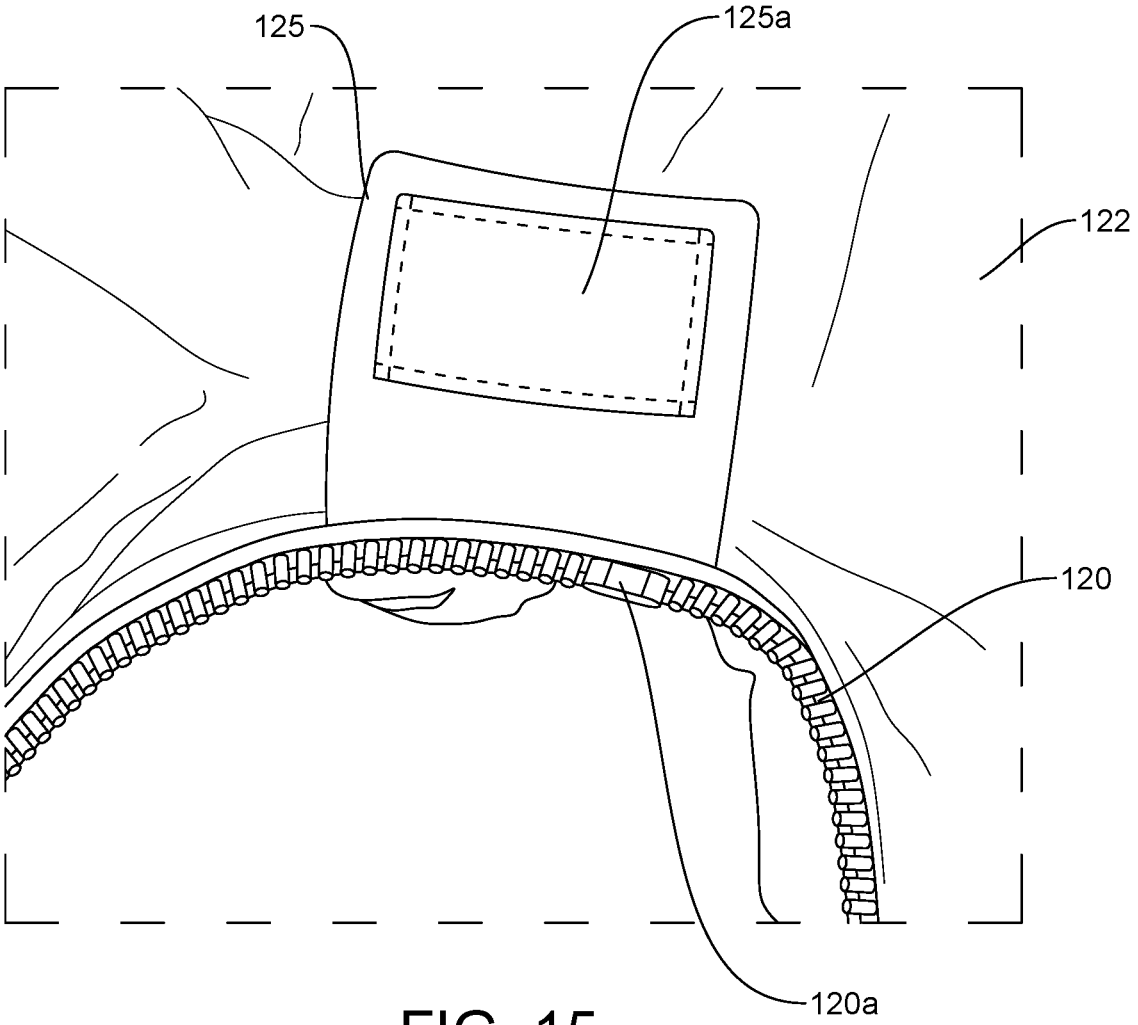
Figure 16:
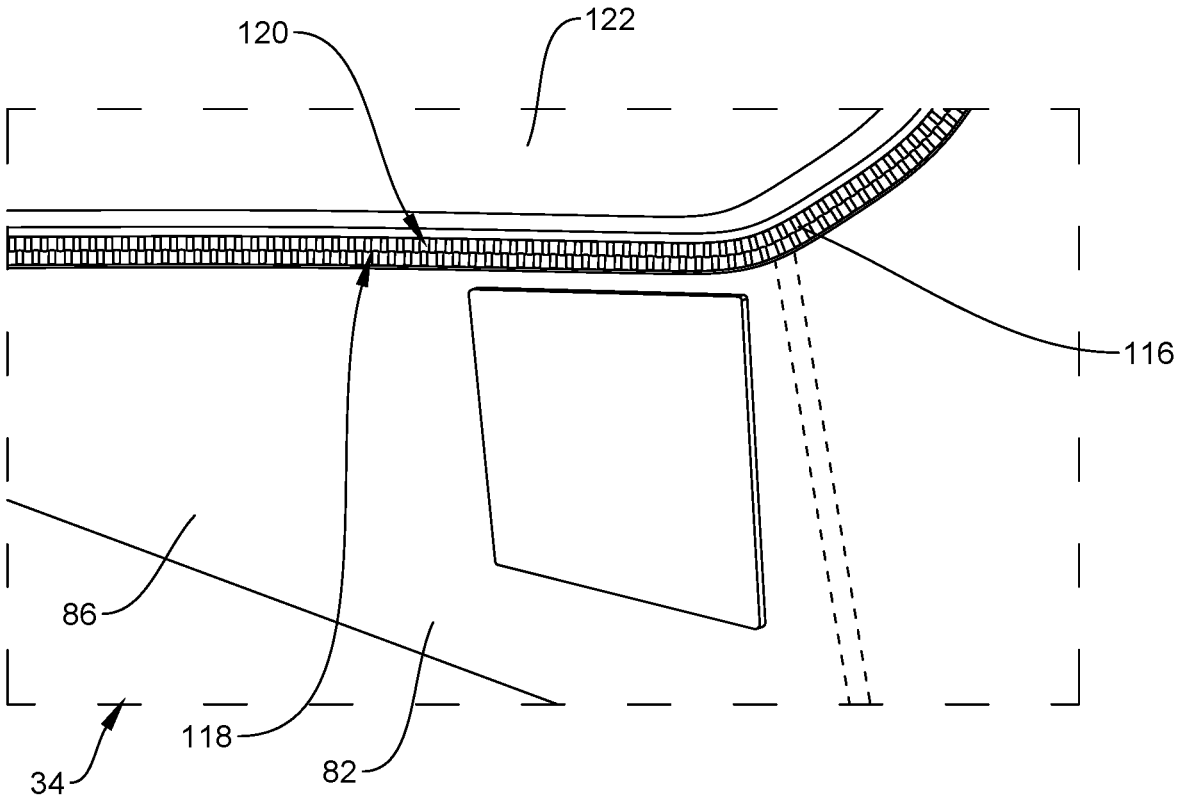
Figure 17:
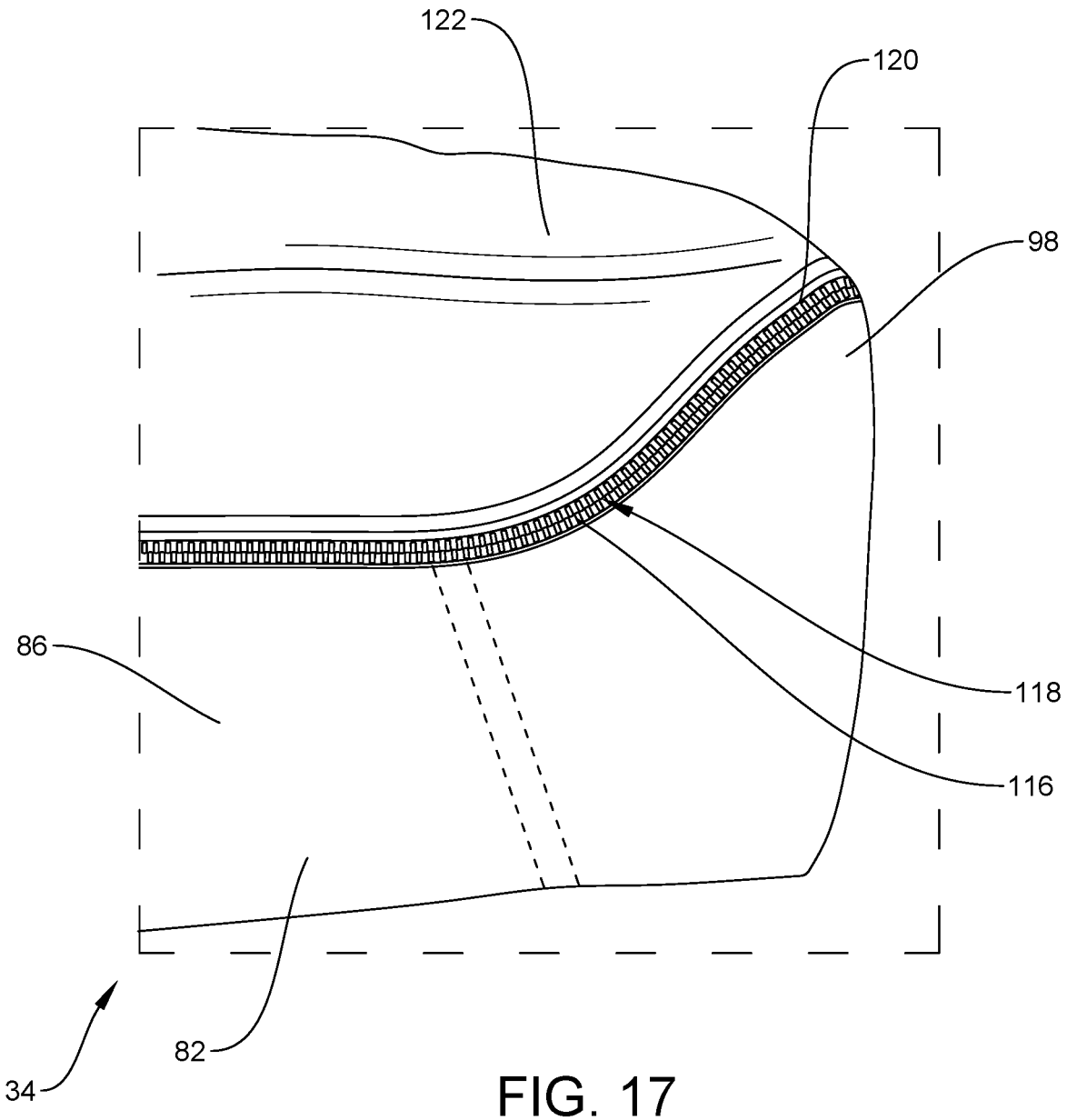
Figure 18:
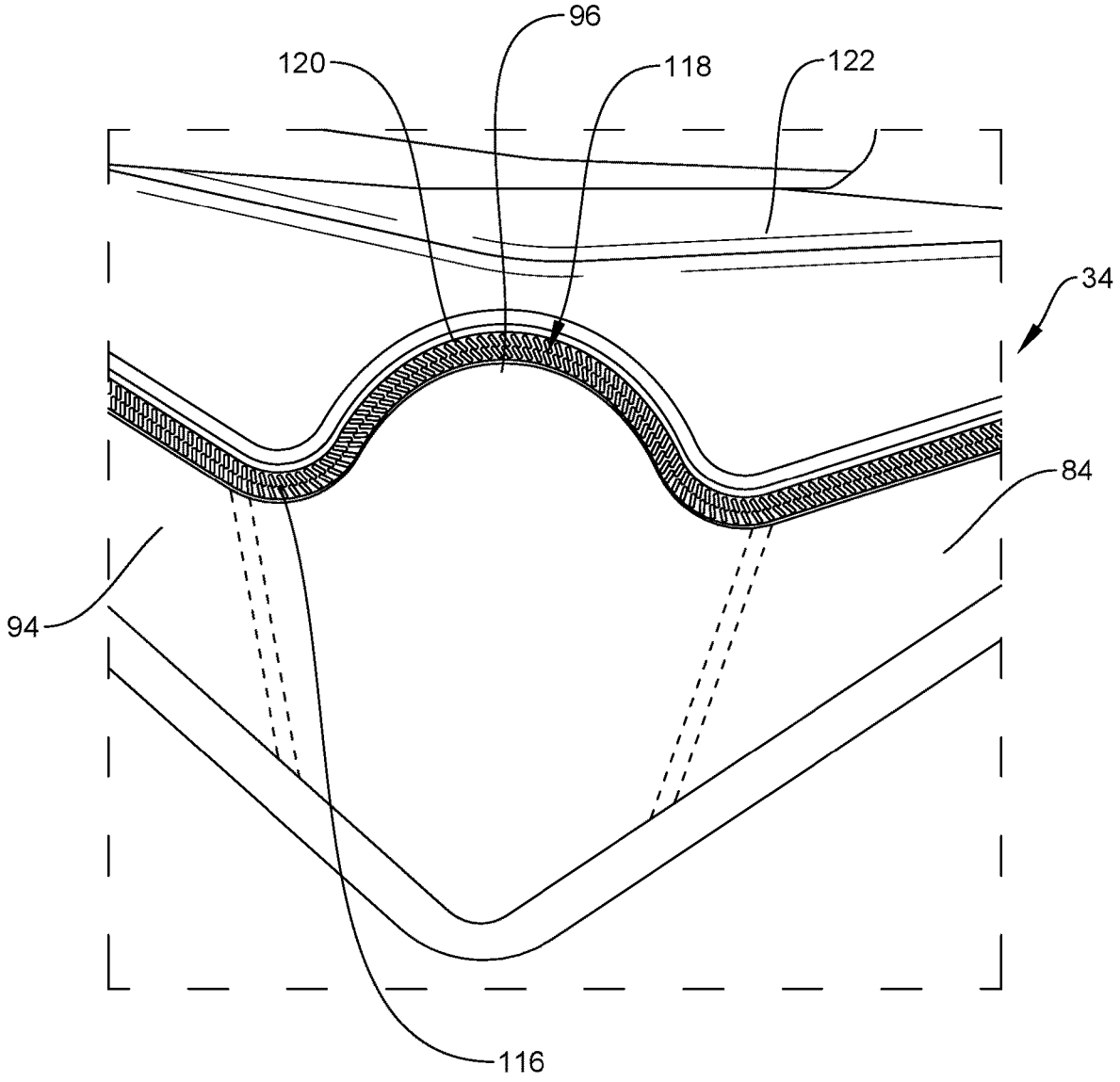
Figure 19:
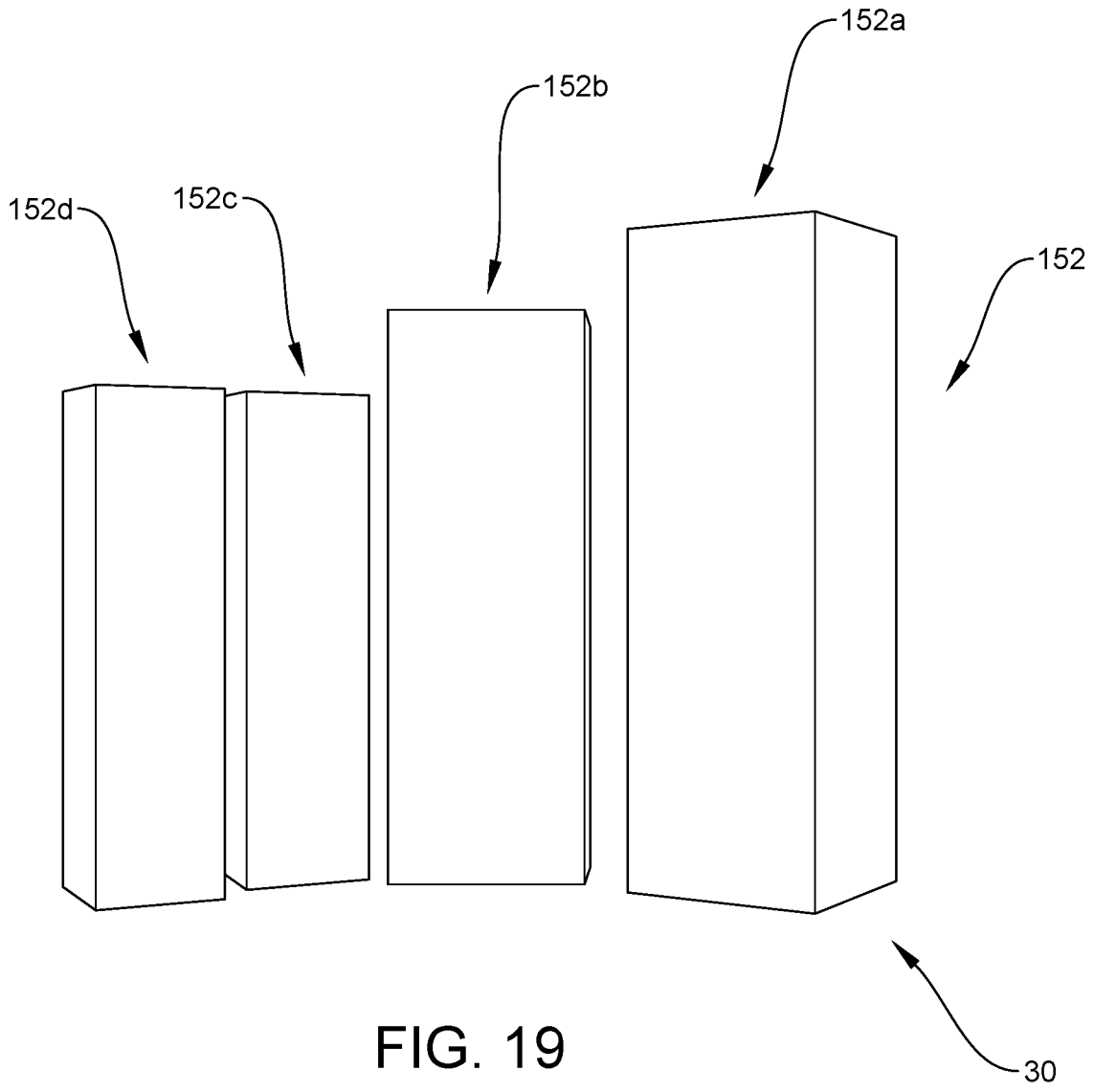
Figure 20:
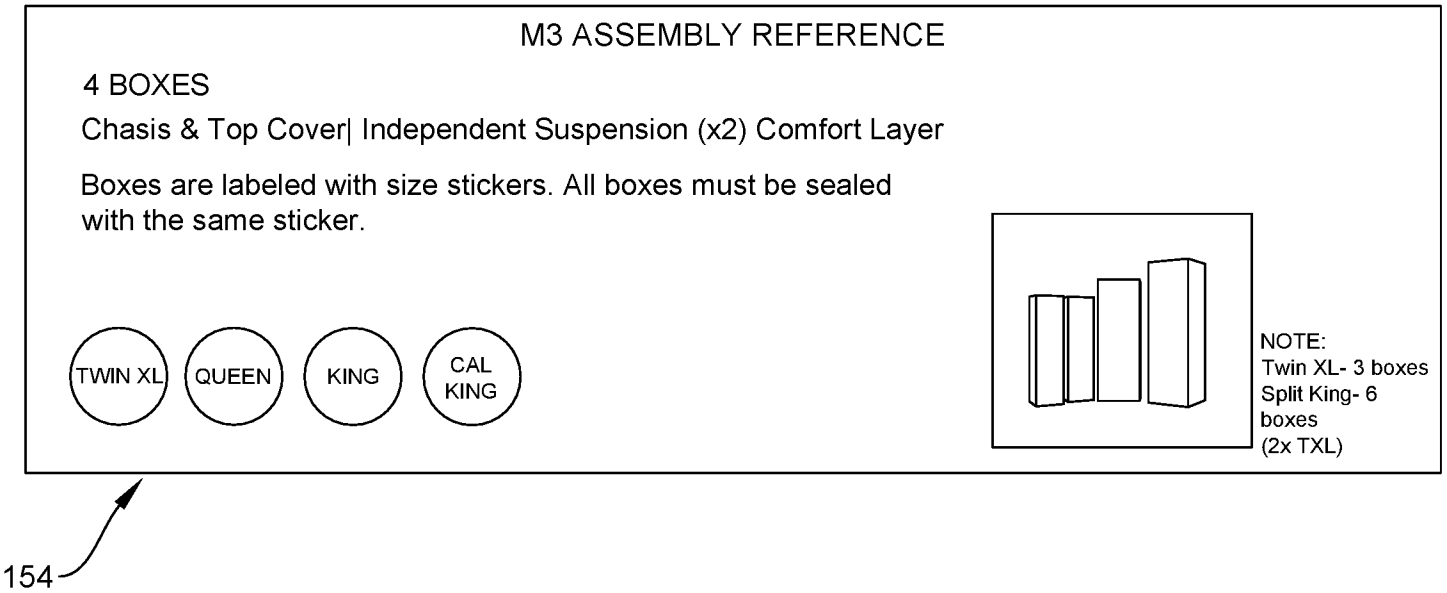
Figure 21:
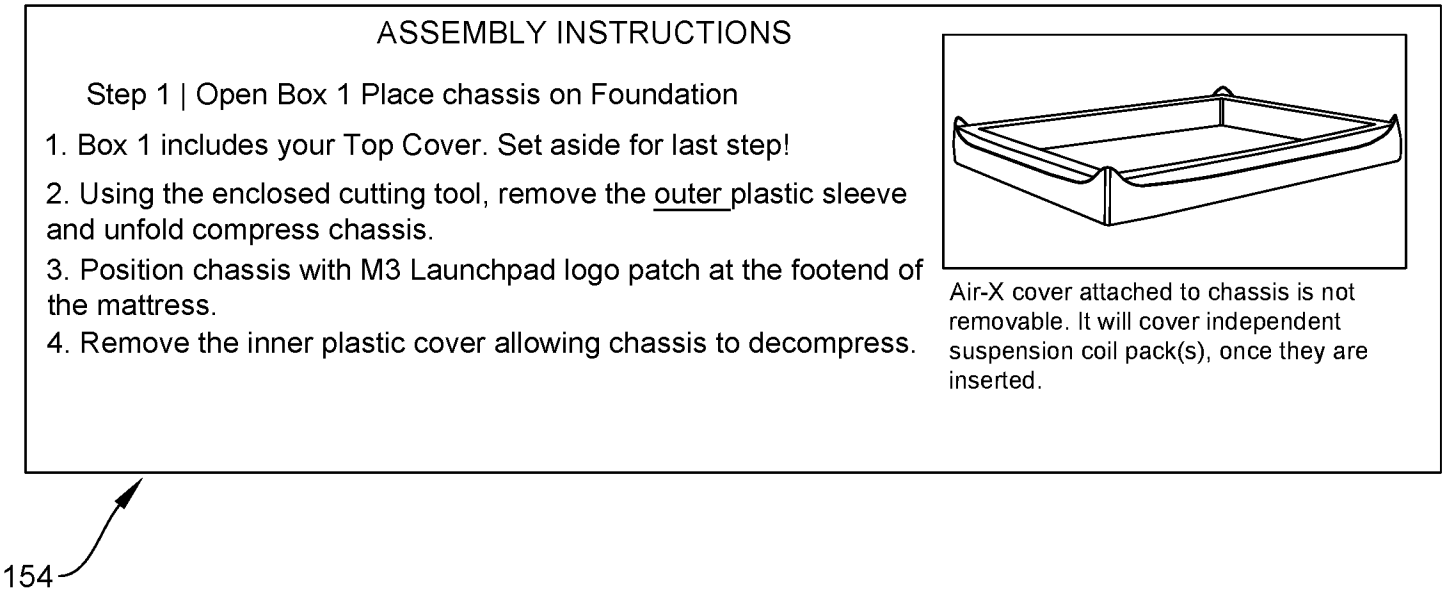
Figure 24:
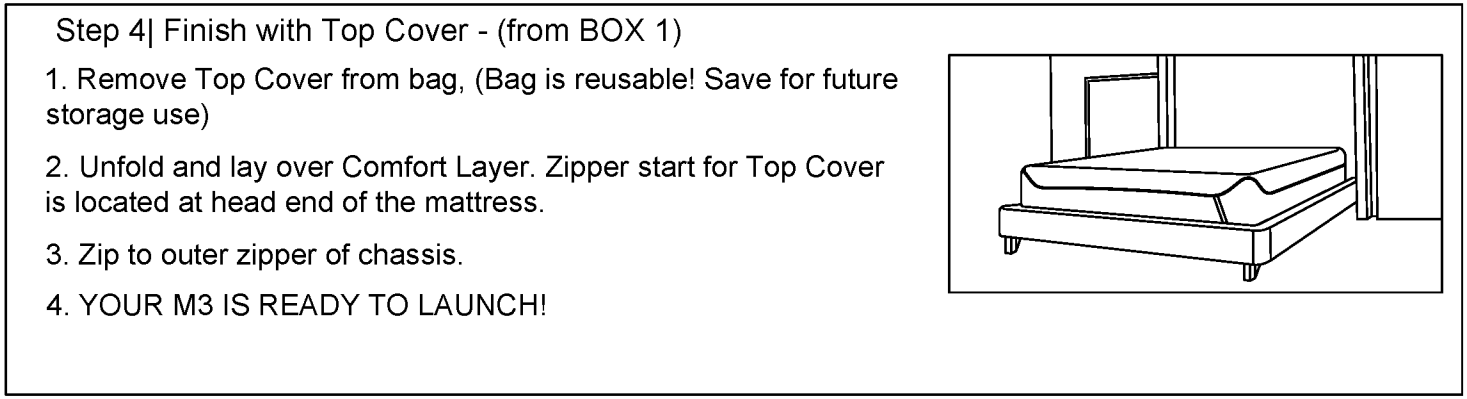

4E is a perspective view of one embodiment of a component of the bedding system shown in FIG. 1, in accordance with the principles of the present disclosure;

4F is a perspective view of one embodiment of a component of the bedding system shown in FIG. 1, in accordance with the principles of the present disclosure;

FIG. 5 is a perspective view of components of the bedding system shown in FIG. 1;

FIG. 5A is a side view, in part phantom, of one embodiment of a component of the bedding system shown in FIG. 1, in accordance with the principles of the present disclosure;

FIG. 5B is a top view, in part phantom, of the component of the mattress assembly shown in FIG. 5A;

FIG. 6 is a perspective view of components of the bedding system shown in FIG. 1;

FIG. 7 is a perspective view of components of the bedding system shown in FIG. 1;

FIG. 8 is a perspective view of components of the bedding system shown in FIG. 1;

FIG. 9 is a top view of components of the bedding system shown in FIG. 1;

FIG. 10 is a top view of components of the bedding system shown in FIG. 1;

FIG. 10A is a top view of one embodiment of components of the bedding system shown in FIG. 1, in accordance with the principles of the present disclosure;

FIG. 11 is a perspective view of components of the bedding system shown in FIG. 1;

FIG. 12 is a top view of components of the bedding system shown in FIG. 1;

FIG. 13 is a perspective view of a component of the bedding system shown in FIG. 1;

FIG. 13A is a bottom view of one embodiment of a component of the bedding system shown in FIG. 1, in accordance with the principles of the present disclosure;

FIG. 13B is a bottom view of one embodiment of a component of the bedding system shown in FIG. 1, in accordance with the principles of the present disclosure;

FIG. 13C is a bottom view of one embodiment of a component of the bedding system shown in FIG. 1, in accordance with the principles of the present disclosure;

FIG. 14 is a side view of components of the bedding system shown in FIG. 1;

FIG. 15 is a side view of components of the bedding system shown in FIG. 1;

FIG. 16 is a side view of components of the bedding system shown in FIG. 1;

FIG. 17 is a side view of components of the bedding system shown in FIG. 1;

FIG. 18 is a perspective view of components of the bedding system shown in FIG. 1;

FIG. 19 is a perspective view of components of the bedding system shown in FIG. 1;

FIG. 20 is a portion of instructions for use with the mattress assembly shown in FIG. 1;

FIG. 21 is a portion of instructions for use with the mattress assembly shown in FIG. 1;

FIG. 22 is a portion of instructions for use with the mattress assembly shown in FIG. 1;

FIG. 23 is a portion of instructions for use with the mattress assembly shown in FIG. 1; and FIG. 24 is a portion of instructions for use with the mattress assembly shown in FIG. 1.

Like reference numerals indicate similar parts throughout the figures.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

The bedding system disclosed herein includes a mattress assembly that is configured to lie on top of a foundation, such as, for example, a box spring. In some embodiments, the mattress assembly of the bedding system is compatible on all types of foundations, including, for example, adjustable bases. In some embodiments, the mattress assembly of the bedding system is configured to cover all or a portion of a top surface of the box spring/foundation. In some embodiments, the mattress assembly of the bedding system is configured to be larger than the top surface of the box spring/foundation. In some embodiments, the mattress assembly of the bedding system has substantially the same size and shape as the top surface of the box spring/foundation. In some embodiments, the mattress assembly of the bedding system is a standard size mattress, such as, for example, a twin mattress, a twin XL mattress, a full mattress, a queen mattress, a king mattress, a split king mattress, or a California king mattress. In some embodiments, the mattress assembly of the bedding system is a crib mattress.

In some embodiments, the mattress assembly of the bedding system is a modular performance mattress that features dual-sided independent suspension and air flow certification in every component of the mattress assembly. In some embodiments, the modular design of the mattress assembly allows a sleeper to personalize his or her comfort. For example, in some embodiments, the mattress assembly can include a plurality of comfort choices for the sleeper and his or her sleep partner. In some embodiments, the mattress assembly is compatible for use with a proven system and consistent fitting history that personalizes components of a bedding system, from a pillow to a mattress assembly.

In some embodiments, the mattress assembly of the bedding system is sustainable as it allows individual components to be upgraded over the lifetime of the mattress assembly. For example, coil packs of the mattress assembly can be replaced if the sleeper's comfort preferences change. It is envisioned that allowing individual components to be upgraded and/or replaced avoids replacing an entire mattress assembly each time a component wears out or needs to be upgraded, thus significantly reducing landfill waste and our carbon footprint.

In some embodiments, the mattress assembly of the bedding system is configured for clean sleep as independent suspension components of the mattress assembly can be removed to allow the inside of a chassis of the mattress assembly to be vacuumed out during periodic deep cleanings. In some embodiments, the mattress assembly includes a top cover and comfort layer that are both removable and washable in cold water on the gentle cycle of a washing machine. In some embodiments, the mattress assembly includes a ventilated construction that prevents warm air and moisture from getting trapped in the mattress, which can lead to the growth of mold and mildew.

In some embodiments, the top cover of the mattress assembly of the bedding system is made from materials selected to provide certain desired characteristics, such as, for example, ventilation. In some embodiments, the top cover can include materials, such as, for example, VER-TEX®, manufactured by Bedgear, LLC of Farmingdale, New York, to provide a cover having a cool touch that is also removable, washable and zips off for easy care. In some embodiments, the VER-TEX® provides instant heat deflection. In some embodiments, the top cover can include materials, such as, for example, AIR-X®, manufactured by Bedgear, LLC of Farmingdale, New York, to provide ventilation inside and out and enhanced air flow that removes humidity and excess body heat. In some embodiments, the top cover includes a quilted design to enhance the feel of the comfort layer.

In some embodiments, the comfort layer of the mattress assembly of the bedding system is made from materials selected to provide certain desired characteristics, such as, for example, support. In some embodiments, the comfort layer can include materials, such as, for example, REACT®, manufactured by Bedgear, LLC of Farmingdale, New York, to provide weightless support that contours to the sleeper and creates cooler comfort. In some embodiments, the comfort layer can include materials, such as, for example, MICRO-CURL®, manufactured by Bedgear, LLC of Farmingdale, New York, to reduce motion transfer. In some embodiments, the comfort layer can include materials, such as, for example, BOOST®, manufactured by Bedgear, LLC of Farmingdale, New York, to provide dynamic support that adapts to the sleeper.

In some embodiments, the independent suspension of the mattress assembly of the bedding system includes individually wrapped coils to provide personalized support. In some embodiments, the coils are 8 inch coils. In some embodiments, the coils are greater than 8 inches. In some embodiments, the coils are less than 8 inches. In some embodiments, the chassis of the mattress assembly of the bedding system is sturdy to provide supportive structure. In some embodiments, the chassis is wrapped in AIR-X®, manufactured by Bedgear, LLC of Farmingdale, New York, to ensure maximum airflow.

In some embodiments, the mattress assembly of the bedding system is delivered to a location in a plurality of boxes. In one embodiment, the chassis and the top cover are packaged in a first box, the independent suspension is packaged in a second box, and the comfort layer is packaged in a third box. In some embodiments, the mattress assembly includes two independent suspensions that are each packaged separately in different boxes. In some embodiments, the mattress assembly includes two independent suspensions that are both packaged together in the same box.

In some embodiments, the mattress assembly of the bedding system is assembled by removing the chassis form a first box and placing the chassis on a foundation. The top cover is removed from the first box and put aside. The chassis is removed from an outer plastic sleeve and is unfolded while compressed. In some embodiments, the chassis is removed from the outer plastic sleeve using a cutting tool that is included in the first box. The chassis is positioned relative to the foundation such that a logo on the chassis is at the foot end of the mattress. The chassis is removed from an inner plastic cover to allow the chassis to decompress.

A coil pack, such as, for example, an independent suspension is removed from a second box using the cutting tool and placed inside the chassis. In some embodiments, the mattress assembly includes two independent suspensions that are each packaged separately in different boxes. In such embodiments, the independents suspensions are each removed from their respective boxes and placed inside of chassis. In some embodiments, the mattress assembly includes two independent suspensions that are both packaged together in the same box. In such embodiments, the independents suspensions are each removed from their shared box and placed inside of chassis. The coil pack is removed from an outer plastic sleeve using the cutting tool to allow the coil pack to unroll. A small incision is made into an inner plastic cover to allow the coils to decompress. As the incision is enlarged, the coils will expand. A cover is placed over the coil packs and is zipped closed with the chassis. In some embodiments, a zipper of the cover and a zipper of the chassis meet in the center, at the foot of the bed.

The comfort layer is removed from a third box and is placed on top of the assembled chassis and independent suspension units. The comfort layer is removed from a plastic outer sleeve using the cutting tool to allow the comfort layer to unroll. Once the comfort layer is unrolled, an inner compression sleeve is pierced using the cutting tool to open the comfort layer. In some embodiments, a zipper start on the comfort layer is positioned at the head end of the bed in order to connect to the chassis. In some embodiments, the comfort layer is rotated relative to the chassis to correct the position of the comfort layer. The comfort layer is then zipped to the chassis.

The top cover is unfolded and laid over the comfort layer. In some embodiments, the zipper start for the top cover is located at the head end of the mattress. The top cover is zipped to an outer zipper of the chassis.

As used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a bedding system in accordance with the principles of the present disclosure. Alternate embodiments are also disclosed. Reference will now be made in detail to the exemplary embodiments of the present disclosure, which are illustrated in the accompanying figures. Turning to FIGS. 1-24, there are illustrated components of a bedding system 30.

System 30 includes a foundation 32 and a mattress assembly 34 that is configured to sit on top of foundation 32 to position a sleep surface 36 of mattress assembly 34 a selected height above a floor F of a room R. In some embodiments, foundation 32 includes a platform 38 and one or a plurality of legs 40 positioned below platform 38. In some embodiments, foundation 32 is adjustable to move a first end 42 of foundation 32 relative to a second end 44 of foundation 32 such that end 42 can be selectively positioned above or below end 44. In some embodiments, end 42 is rotatable relative to end 44 about one or more hinges. In some embodiments, foundation 32 is not adjustable and end 42 is fixed relative to end 44.

In some embodiments, platform 38 is substantially rectangular and includes four corners, with one of legs 40 being positioned at each of the corners. In some embodiment, platform 38 is substantially rectangular and includes four corners, with one of legs 40 being positioned only at two of the corners at end 44 of platform 38 and the two corners at end 42 of platform 38 being free of legs 40. In some embodiments, end 42 of platform 38 is coupled to a wall W or rail in room R to position end 42 of platform 38 a selected height above floor F.

In some embodiments, foundation 32 has a footprint that is the same or substantially the same as the footprint of mattress assembly 34. That is, outermost walls of mattress assembly 34 are flush with outermost walls of foundation 32. In such embodiments, foundation 32 has a maximum area in a horizontal plane that is equal to a maximum area of mattress assembly 34 in the horizontal plane, wherein the maximum areas are defined by perimeters of foundation 32 and mattress assembly 34. In such embodiments, gravity prevents movement of mattress assembly 34 relative to foundation 32.

In some embodiments, foundation 32 has a footprint that is greater than the footprint of mattress assembly 34 to better prevent movement of mattress assembly 34 relative to foundation 32. That is, outermost walls of foundation 32 extend beyond outermost walls of mattress assembly 34, as shown in FIG. 1. In such embodiments, foundation 32 has a maximum width W1 that is greater than a maximum width W2 of mattress assembly 34 and foundation 32 has a maximum length L1 that is greater than a maximum length L2 of mattress assembly 34. In some embodiments, width W1 is between about 5% and about 50% greater than width W2. In some embodiments, width W1 is between about 5% and about 25% greater than width W2. In some embodiments, width W1 is between about 5% and about 15% greater than width W2. In some embodiments, length L1 is between about 5% and about 50% greater than length L2. In some embodiments, length L1 is between about 5% and about 25% greater than length L2. In some embodiments, length L1 is between about 5% and about 15% greater than length L2.

In some embodiments, platform 38 includes at least one end wall 46 that extends from a side wall 48 of platform 38 to an opposite side wall 50 of platform 38. Walls 46, 48, 50 define a frame. Inner surfaces of walls 46, 48, 50 define a cavity 52 configured for disposal of mattress assembly 34. Cavity 52 has a size and shape that allows the entire footprint or perimeter of mattress assembly 34 to be positioned within cavity 52. In some embodiments, an outer surface of mattress assembly 34 directly engages the inner surfaces of walls 46, 48, 50 when mattress assembly 34 is positioned in cavity 52 to maintain mattress assembly 34 between wall 48 and wall 50 and between wall 46 and a wall W of room R to prevent mattress assembly 34 from moving relative to foundation 32.

In some embodiments, mattress assembly 34 is removably coupled to foundation 32 such that mattress assembly 34 can be removed from foundation 32 to clean within cavity 52, for example. In some embodiments, mattress assembly 34 is permanently fixed to foundation 32 to prevent unintended movement of mattress assembly 34 relative to foundation 32. In some embodiments, mattress assembly 34 can be variously connected with foundation 32, such as, for example, monolithic, integral connection, frictional engagement, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Mattress assembly 34 includes a chassis 54 comprising a bottom wall 56, a side wall 58, a side wall 60 opposite wall 58, an end wall 62 and an end wall 64 opposite wall 62. Wall 58 extends parallel to wall 60 and wall 62 extends parallel to wall 64. In some embodiments, walls 58, 60 each extend perpendicular to walls 62, 64. Walls 58, 60, 62, 64 each extend upwardly from wall 56. In some embodiments, walls 56, 58, 60, 62, 64 define a body of chassis 54. A top surface 56*a* of wall 56, an inner surface 58*a* of wall 58, an inner surface 60*a* of wall 60, an inner surface 62*a* of wall 62 and an inner surface 64*a* of wall 64 define a cavity 66 configured for disposal of a component of mattress assembly 34, such as, for example, one or more independent suspensions or coil packs 68, as discussed herein. In some embodiments, cavity 66 has a size and shape that is configured to match the size and shape of coil pack(s) 68 to prevent relative movement of coil pack(s) 68 relative to chassis 54 when coil pack(s) 68 is/are positioned within cavity 66, as discussed herein. In some embodiments, cavity 66 is variously shaped, such as, for example, circular, oval, oblong, triangular, rectangular, square, polygonal, irregular, uniform, non-uniform, offset, staggered, undulating, arcuate, variable and/or tapered.

Figure 4:
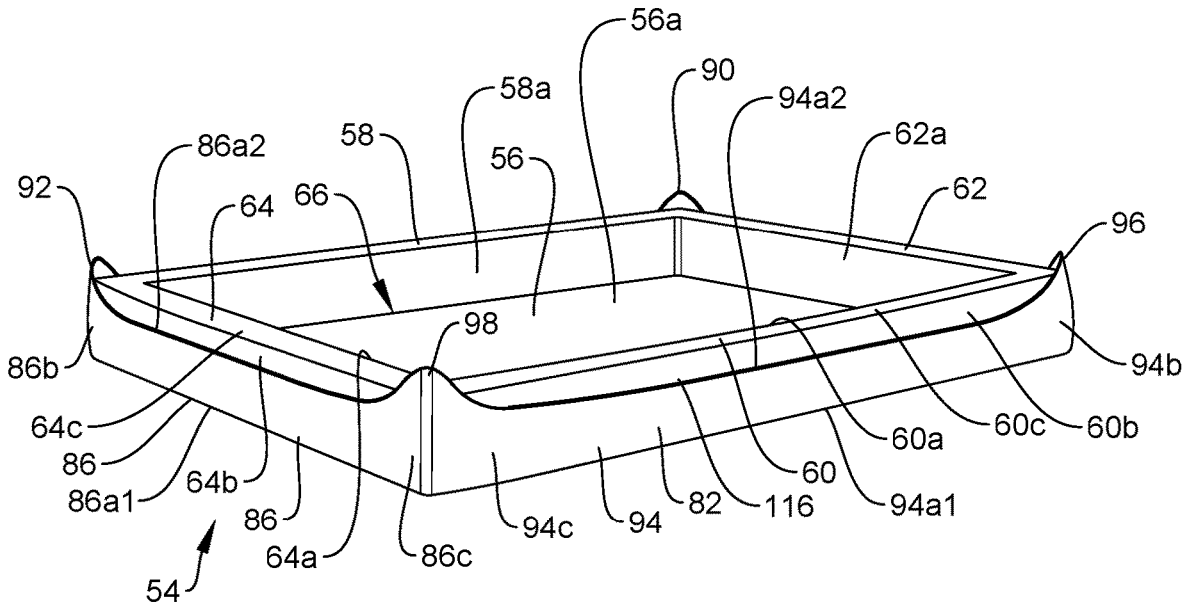
FIG. 4 is a perspective view of a component of the bedding system shown in FIG. 1.
Figure 4A:
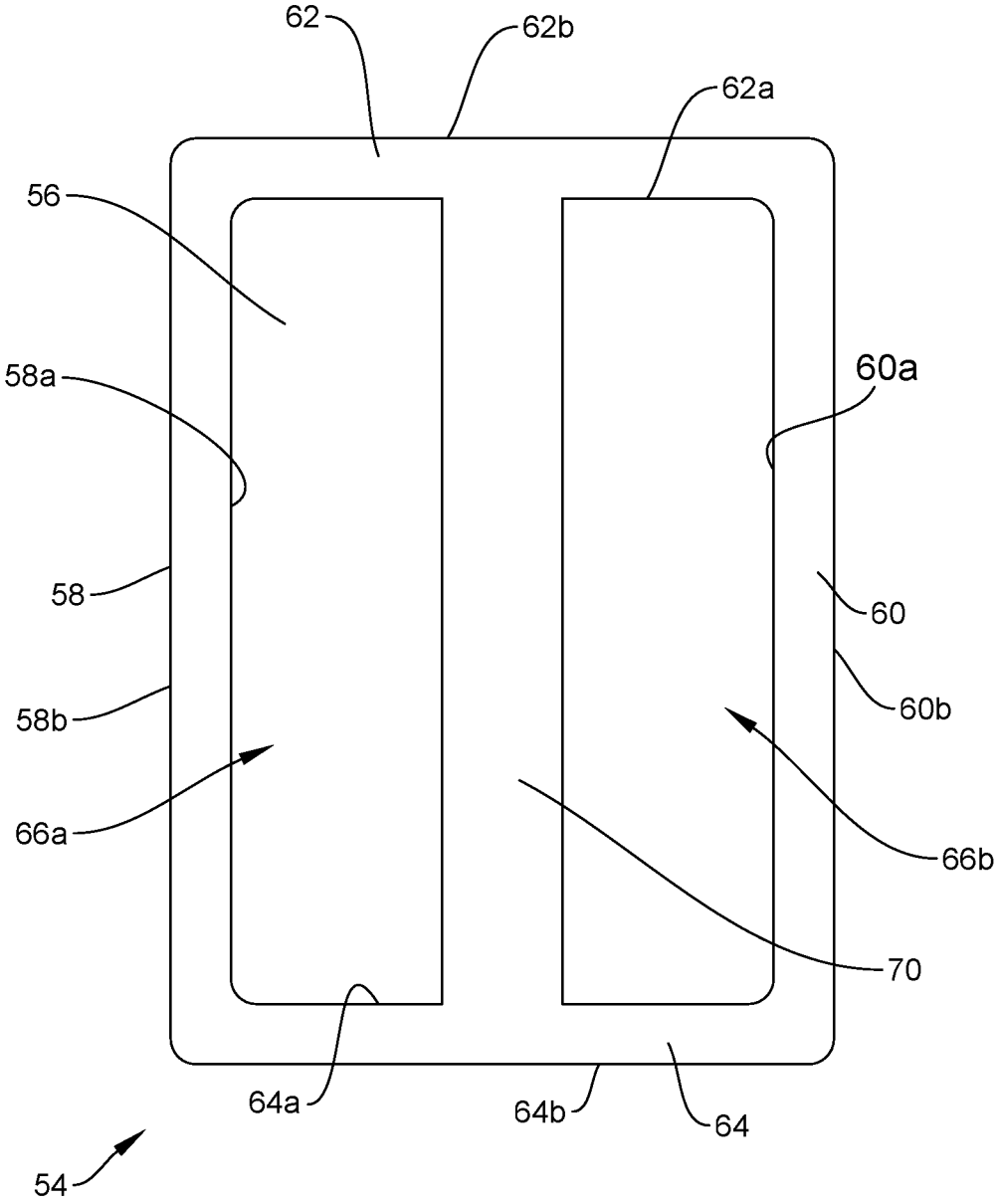
FIG. 4A is a top view of one embodiment of a component of the bedding system shown in FIG. 1, in accordance with the principles of the present disclosure.
Figure 4B:
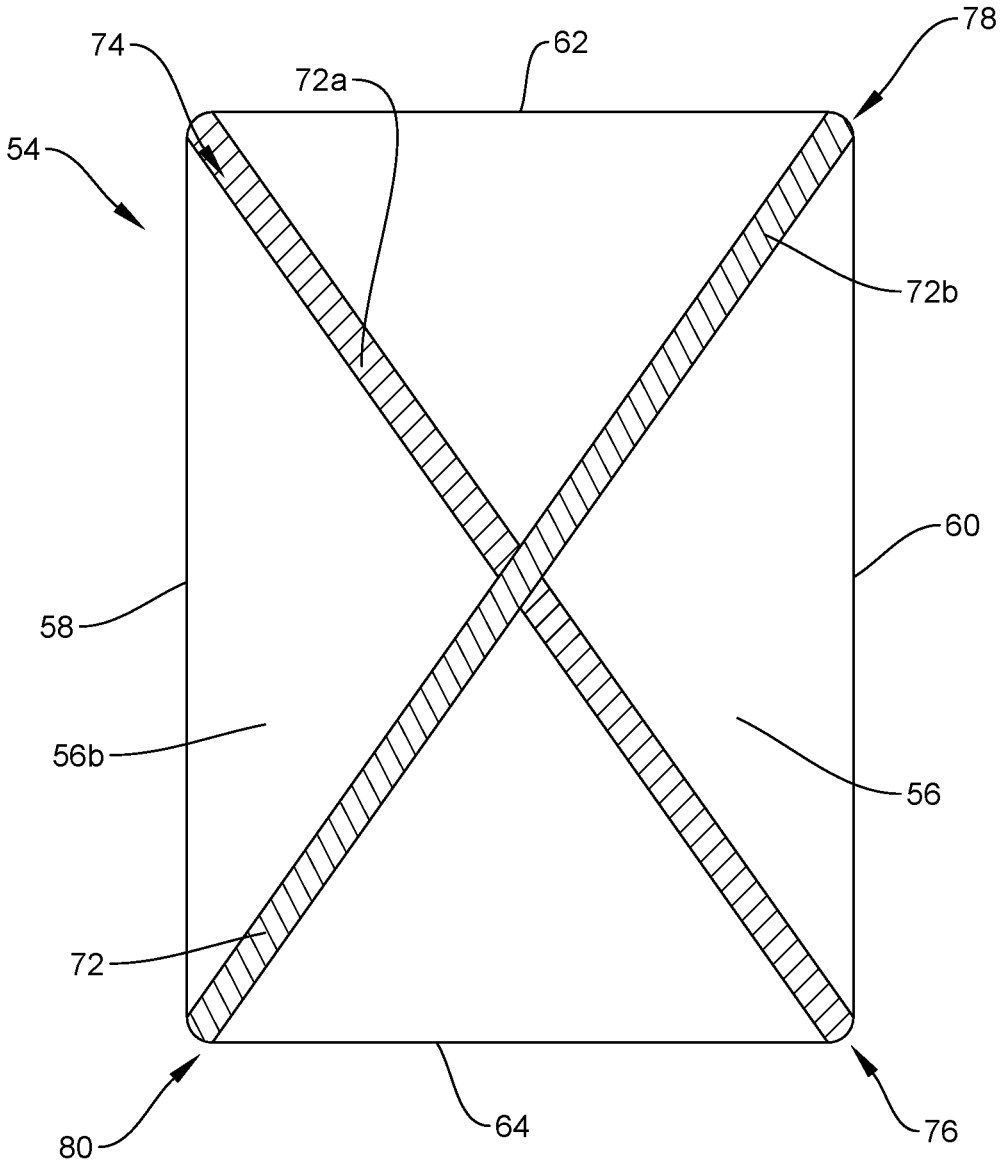
FIG. 4B is a bottom view of one embodiment of a component of the bedding system shown in FIG. 1, in accordance with the principles of the present disclosure.

In some embodiments, chassis 54 includes only one cavity between wall 58 and wall 60 and between wall 62 and wall 64, as shown in FIG. 4. That is, chassis 54 does not include any cavities between wall 58 and wall 60 and/or between wall 62 and wall 64 in addition to cavity 66. In some embodiments, chassis 54 includes a divider 70 that extends from wall 62 to wall 64. Divider 70 separates cavity 66 into a first cavity 66*a* and a second cavity 66*b*, as shown in FIG. 4A. In some embodiments, divider 70 is removable from wall 62 and/or wall 64. This allows a sleeper the option to either have a single coil pack 68 in a single cavity 66 or have a first coil pack 68*a* in cavity 66*a* and a second coil pack 68*b* in cavity 66*b*. In some embodiments, divider 70 is integrally formed with wall 62 and/or wall 64 to provide strength and/or rigidity to chassis 54. In some embodiments, coil packs 68*a*, 68*b* are each disposed in cavity 66 wherein cavity 66 is a single cavity without divider 70.

In some embodiments, chassis 54 is compressible to allow chassis to be rolled and/or folded. That is, chassis 54 is configured to move from a rolled and/or folded configuration to an unrolled and/or unfolded configuration. This allows chassis 54 to be positioned in a container, such as, for example, a cardboard box when chassis 54 is in the rolled and/or folded configuration. Chassis 54 is removed from the box while chassis is in the rolled and/or folded configuration. Chassis 54 is then placed on a surface, such as, for example, platform 38 and is moved from the rolled and/or folded configuration to the unrolled and/or unfolded configuration. In some embodiments, wall 56 is made from a fabric material and walls 58, 60, 62, 64 are each made from a compressible material, such as, for example, foam. In some embodiments, the foam is memory foam, latex foam, or another compressible and/or breathable foam. In some embodiments, walls 58, 60, 62, 64 each consist of foam. That is, wall 58 consists of memory foam from surface 58*a* to an opposite outer surface 58*b* of wall 58; wall 60 consists of memory foam from surface 60*a* to an opposite outer surface 60*b* of wall 60; wall 62 consists of memory foam from surface 62*a* to an opposite outer surface 62*b* of wall 62; and wall 64 consists of memory foam from surface 64*a* to an opposite outer surface 64*b* of wall 64. In some embodiments, walls 58, 60, 62, 64 are each made of one or more materials and are each homogeneous along the entire thicknesses and heights thereof.

In some embodiments, surfaces 58*a*, 58*b*, 58*c* of wall 58, surfaces 60*a*, 60*c* of wall 60, surfaces 62*a*, 62*b* and 62*c* of wall 62, and surfaces 64*a*, 64*b* and 64*c* of wall 64 are each made from a breathable material, such as, for example, AIR-X®, manufactured by Bedgear, LLC of Farmingdale, New York. In such embodiments, wall 58 comprises or consists of memory foam between surfaces 58*a*, 58*b* and between surface 58*c* and wall 56; wall 60 comprises or consists of memory foam between surfaces 60*a*, 60*b* and between surface 60*c* and wall 56; wall 62 comprises memory foam between surfaces 62*a*, 62*b* and between surface 62*c* and wall 62; and wall 64 comprises memory foam between surfaces 64*a*, 64*b* and between surface 64*c* and wall 64.

In some embodiments, walls 58, 60, 62, 64 are each free of any hard and/or rigid material, such as, for example, metal, plastic and wood to allow chassis 54 to move between the rolled and/or folded configuration and the unrolled and/or unfolded configuration. In some embodiments, walls 58, 60, 62, 64 are each free of any hinges or joints. Indeed, chassis 54 relies upon the material that forms walls 58, 60, 62, 64, rather than hinges or joints, to move chassis 54 between the rolled and/or folded configuration and the unrolled and/or unfolded configuration. In some embodiments, at least one of walls 58, 60, 62, 64 includes a plurality of spaced apart divots or notches that extend into surface 58*c*, surface 60*c*, surface 62*c* and/or surface 64*c* to facilitate rolling of chassis 54.

Wall 56 includes a bottom surface 56*b* opposite surface 56*a*. Surface 56*b* is configured to directly engages a surface, such as, for example, a top surface of platform 38. In some embodiments, surface 56*b* comprises a non-skid material, such as, for example, rubber or a thermoplastic elastomer material and/or is roughened to prevent movement of chassis 54 relative to foundation 32. In some embodiments, wall 56 consists of a fabric material. In some embodiments, the fabric material is breathable to allow air and/or moisture to move through a thickness of wall 56. In some embodiments, wall 56 is highly porous. In some embodiments, wall 56 includes pores that are greater than 0.5 microns. In some embodiments, wall 56 includes pores that are greater than 3.0 microns. In some embodiments, wall 56 includes pores that are greater than 10.0 microns. In some embodiments, wall 56 is free of any hard and/or rigid material, such as, for example, metal, plastic and wood to allow chassis 54 to move between the rolled and/or folded configuration and the unrolled and/or unfolded configuration. In some embodiments, wall 56 is free of any hinges or joints. Indeed, chassis 54 relies upon the material that forms wall 56, rather than hinges or joints to move chassis 54 between the rolled and/or folded configuration and the unrolled and/or unfolded configuration.

In some embodiments, wall 56 is made from a fabric material, such as, for example, a spandex material. That is, the fabric material of wall 56 defines a base material of wall 56. In some embodiments, wall 56 includes one or a plurality of cords, such as, for example, straps 72 that are configured to provide strength to chassis 54, as discussed herein. In some embodiments, one or more of straps 72 are defined by stitching that is stitched into the base material such that straps 72 define areas of reinforced stitching that limit the stretchability of the base material in at least one direction such that mattress assembly 34 is sturdy when assembled, as discussed herein. In some embodiments, one or more of straps 72 are defined by a material that is attached to the base material. In some embodiments, straps 72 are positioned on or in surface 56*a* and/or surface 56*b*. For example, straps 72 can be positioned on one or more sides of wall 56.

In one embodiment, wall 56 includes at least one strap 72 that extends diagonally across wall 56. For example, in one embodiment, wall 56 includes a strap 72*a* that extends from a corner 74 of chassis 54 that is defined by an interface between wall 58 and wall 62 to a corner 76 of chassis 54 that is defined by an interface between wall 60 and wall 64 and/or a strap 72*b* that extends from a corner 78 of chassis 54 that is defined by an interface between wall 60 and wall 62 to a corner 80 of chassis 54 that is defined by an interface between wall 58 and wall 64. In some embodiments, wall 56 includes strap 72*a* and/or strap 72*b* and/or one or more additional diagonal straps 72. In some embodiments, strap 72*a* defines the maximum distance between corner 74 and corner 76. That is, strap 72*a* prevents corner 74 from being spaced apart from corner 76 a distance that is greater than the maximum length of strap 72*a*. In some embodiments, strap 72*b* defines the maximum distance between corner 78 and corner 80. That is, strap 72*b* prevents corner 78 from being spaced apart from corner 80 a distance that is greater than the maximum length of strap 72*b*.

Figure 4C:
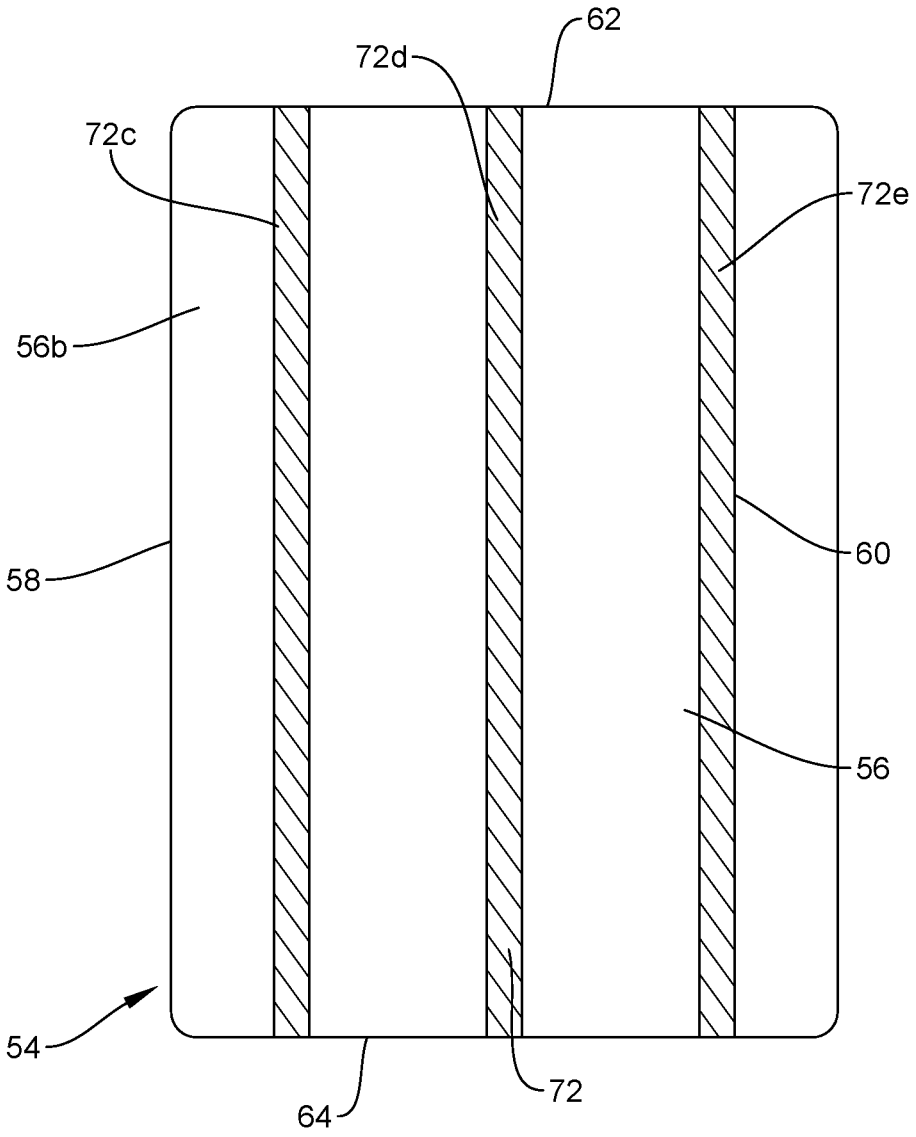
FIG. 4C is a bottom view of one embodiment of a component of the bedding system shown in FIG. 1, in accordance with the principles of the present disclosure.

In one embodiment, wall 58 includes at least one strap 72 that extends vertically across wall 58. For example, in one embodiment, wall 56 includes spaced apart straps 72*c*, 72*d*, 72*e* that each extend from wall 62 to wall 64, as shown in FIG. 4C, in addition to or in place of strap 72*a*, strap 72*b* and/or any additional diagonal straps 72. In some embodiments, strap 72*d* is positioned equidistant between wall 58 and wall 60; strap 72*c* is positioned equidistant between wall 58 and strap 72*d*; and strap 72*e* is positioned equidistant between wall 60 and strap 72*d*. In some embodiments, strap 72*c* is closer to one of wall 58 or strap 72*d* than the other one of wall 58 or strap 72*d* and/or strap 72*e* is closer to one of wall 60 or strap 72*d* than the other one of wall 58 or strap 72*d*. In some embodiments, wall 56 includes strap 72*c*, strap 72*d* and/or strap 72*e* and/or one or more additional vertical straps 72. In some embodiments, strap 72*c*, strap 72*d* and/or strap 72*e* define(s) the maximum distance between surface 62*b* and surface 64*b*. That is, strap 72*c*, strap 72*d* and/or strap 72*e* prevent(s) surface 62*b* from being spaced apart from surface 64*b* a distance that is greater than the maximum width of strap 72*c*, strap 72*d* and/or strap 72*e*.

Figure 4D:
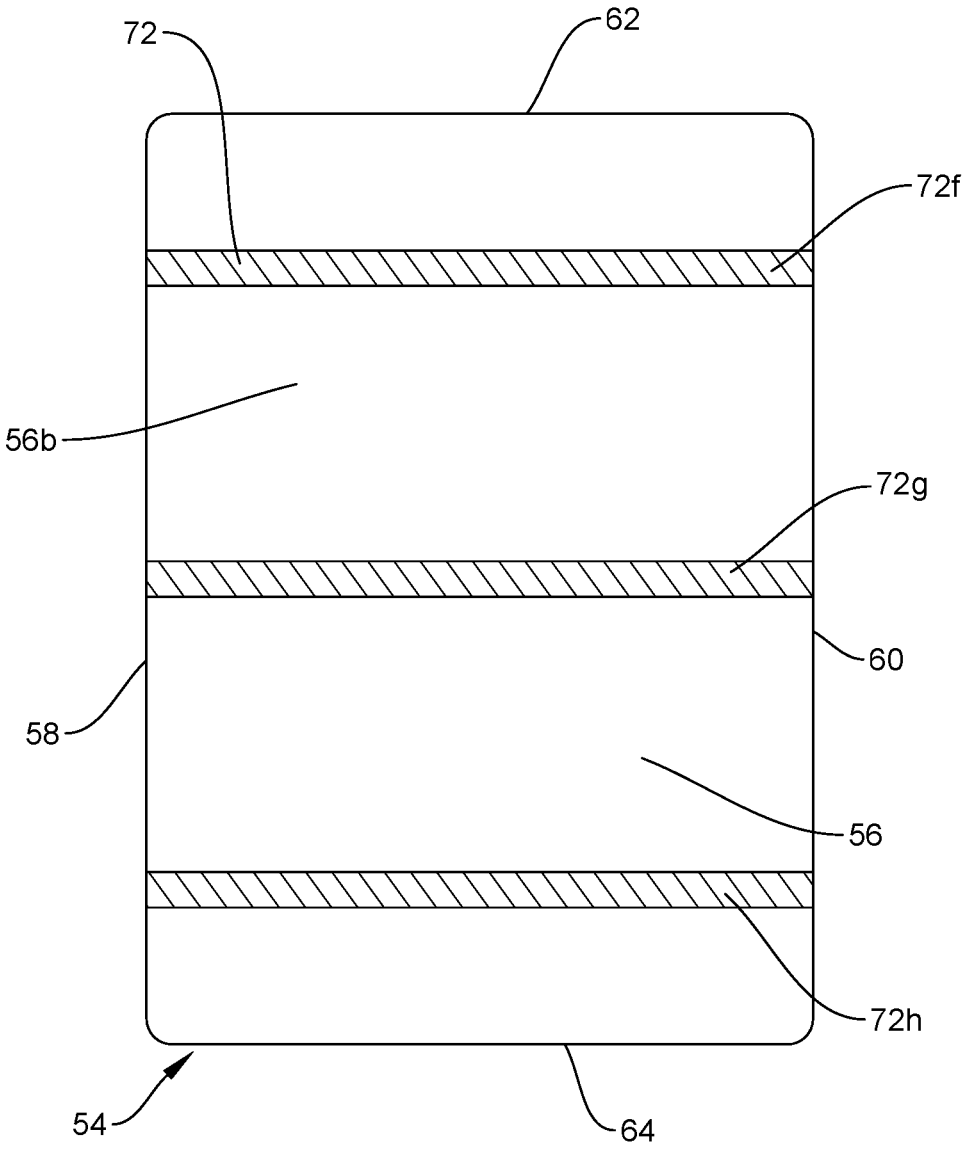
FIG. 4D is a bottom view of one embodiment of a component of the bedding system shown in FIG. 1, in accordance with the principles of the present disclosure.

In one embodiment, wall 58 includes at least one strap 72 that extends horizontally across wall 58. For example, in one embodiment, wall 56 includes spaced apart straps 72*f*, 72*g*, 72*h* that each extend from wall 58 to wall 60, as shown in FIG. 4D, in addition to or in place of strap 72*a*, strap 72*b*, strap 72*c*, strap 72*d* and/or strap 72*e*. In some embodiments, strap 72*g* is positioned equidistant between wall 62 and wall 64; strap 72*f* is positioned equidistant between wall 62 and strap 72*g*; and strap 72*h* is positioned equidistant between wall 64 and strap 72*g*. In some embodiments, strap 72*f* is closer to one of wall 62 or strap 72*g* than the other one of wall 62 or strap 72*g* and/or strap 72*h* is closer to one of wall 64 or strap 72*g* than the other one of wall 64 or strap 72*g*. In some embodiments, wall 56 includes strap 72*e*, strap 72*f* and/or strap 72*g* and/or one or more additional horizontal straps 72. In some embodiments, strap 72*f*, strap 72*g* and/or strap 72*h* define(s) the maximum distance between surface 58*b* and surface 60*b*. That is, strap 72*f*, strap 72*g* and/or strap 72*h* prevent(s) surface 58*b* from being spaced apart from surface 60*b* a distance that is greater than the maximum width of strap 72*f*, strap 72*g* and/or strap 72*h*.

Figure 4E:
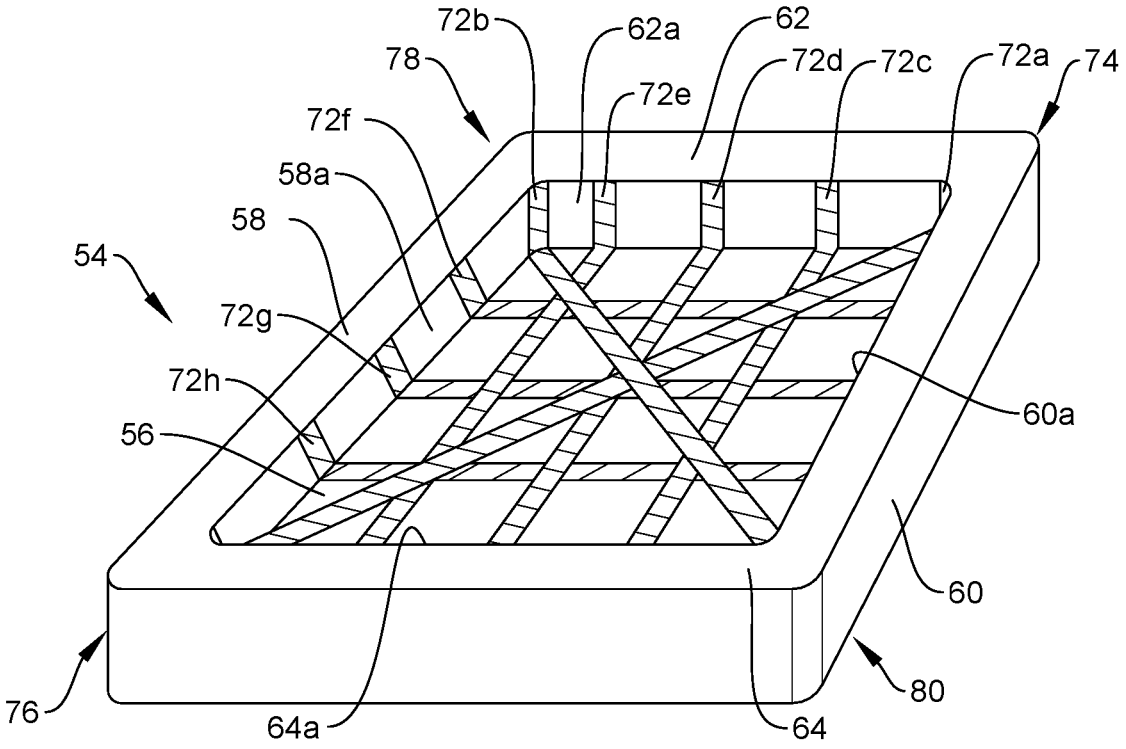
Figure 4F:
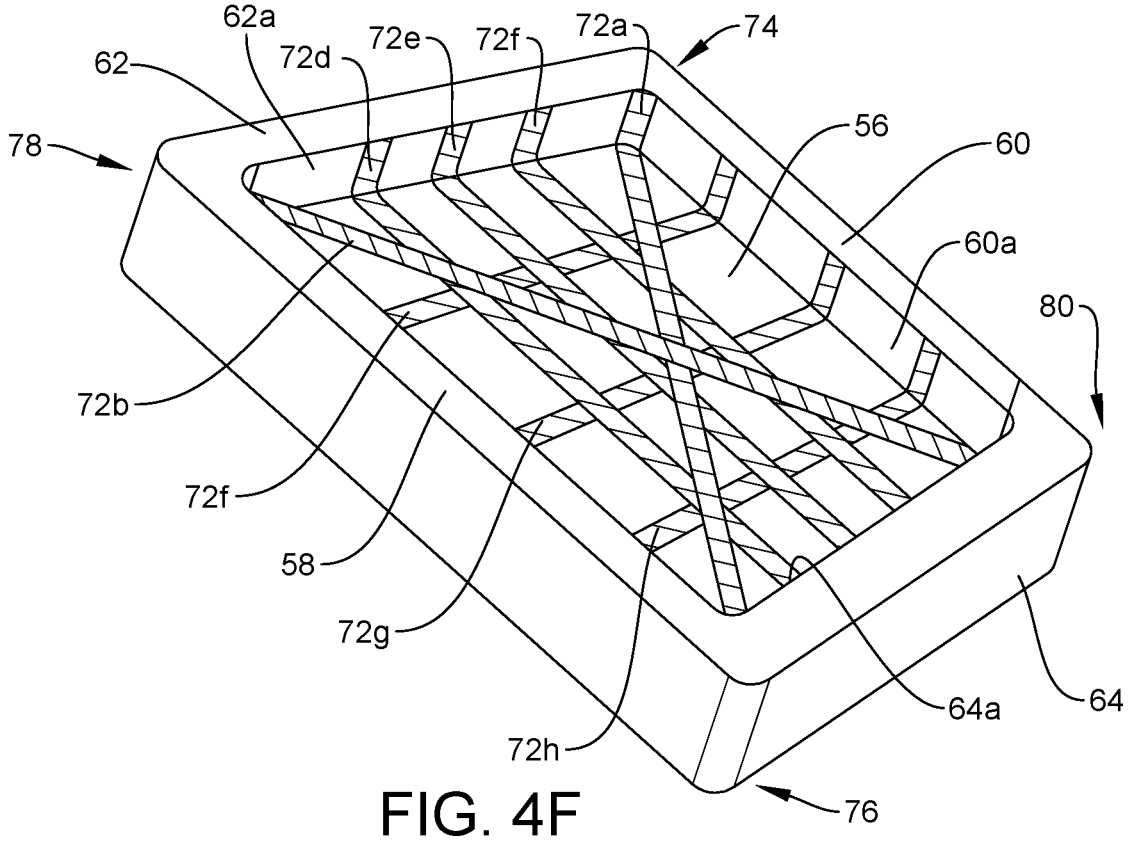

In some embodiments, strap 72*a*, strap 72*b*, strap 72*c*, strap 72*d*, strap 72*e*, strap 72*f*, strap 72*g* and/or strap 72*h* extend onto one or more of surfaces 58*a*, 60*a*, 62*a*, 62*a*, as shown in FIGS. 4E and 4F. For example, in some embodiments, straps 72*a*, 72*b*, 72*c*, 72*d*, 72*e* each extend across wall 56 from surface 62*a* to surface 64*a* and straps 72*f*, 72*g*, 72*h* each extend across wall 56 from surface 58*a* to surface 60*a*. Straps 72*a*, 72*b*, 72*c*, 72*d*, 72*e* will thus limit the ability of walls 58, 60, 62, 64 from moving relative to one another.

That is, straps 72*a*, 72*b*, 72*c*, 72*d*, 72*e* are configured to limit the distance wall 58 can be spaced apart from wall 60, the distance wall 60 can be spaced apart from wall 62, the distance corner 74 can be spaced apart from corner 76 and the distance corner 78 can be spaced apart from corner 80. Stated another way, straps 72*a*, 72*b*, 72*c*, 72*d*, 72*e* prevent wall 58 from being spaced apart from wall 60 more than the maximum lengths of straps 72*c*, 72*d*, 72*e*, prevent wall 60 from being spaced apart from wall 62 more than the maximum lengths of straps 72*f*, 72*g*, 72*h*, prevent corner 74 from being spaced apart from corner 76 more than the maximum length of strap 72*a* and prevent corner 78 from being spaced apart from corner 80 more than the maximum length of strap 72*b*.

In some embodiments, chassis 54 includes a jacket 82 that is coupled to surfaces 58*b*, 60*b*, 62*b*, 64*b*. Jacket 82 defines an outermost surface of chassis 54. That is, walls 58, 60, 62, 64 are each positioned within jacket 82 such that surfaces 58*b*, 60*b*, 62*b*, 64*b* directly engage an inner surface of jacket 82. In some embodiments, jacket 82 is made from a breathable material, such as, for example, AIR-X®, manufactured by Bedgear, LLC of Farmingdale, New York, to provide ventilation inside and out of chassis 54 and enhanced air flow that removes humidity and excess body heat from cavity 66. In some embodiments, jacket 82 is highly porous. In some embodiments, jacket 82 includes pores that are greater than 0.5 microns. In some embodiments, jacket 82 includes pores that are greater than 3.0 microns. In some embodiments, jacket 82 includes pores that are greater than 10.0 microns. In some embodiments, jacket 82 has a porosity that is greater than a porosity of walls 58, 60, 62, 64. In some embodiments, jacket 82 and surfaces 58*b*, 60*b*, 62*b*, 64*b* define one or more pockets therebetween. Due to the increased porosity of jacket 82 relative to walls 58, 60, 62, 64, air and/or or moisture in the pocket(s) will exit chassis 54 through pores in jacket 82. In some embodiments, chassis 54 is configured to have air and/or moisture in cavity 66 move through walls 58, 60, 62, 64 and into the pocket(s) defined by jacket 82 and surfaces 58*b*, 62*b*, 64*b*. As such, air and/or moisture in cavity 66 will move through walls 58, 60, 62, 64 and into the pocket(s) defined by jacket 82 and surfaces 58*b*, 60*b*, 62*b*, 64*b*. The air and/or moisture in the pocket(s) will then exit the pocket(s) through jacket 82.

Jacket 82 includes an end 84 having a central section 84*a* positioned between opposite end sections 84*b*, 84*c*. Section 84*a* includes a bottom surface 84*a*1 that engages wall 56 and an opposite top surface 84*a*2 that is positioned between wall 56 and a top surface 62*c* of wall 62. Sections 84*b*, 84*c* each extend above surface 62*c*, as shown in FIG. 6, for example. In some embodiments, end 84 is concavely curved between section 84*a* and section 84*b* and between section 84*a* and section 84*c* such that a portion of each of sections 84*b*, 84*c* are positioned above surface 62*c*. In some embodiments, section 84*a* is permanently fixed relative to wall 62 along an entire length of section 84*a*. That is, no part of section 84*a* is movable relative to wall 62.

Jacket 82 includes an end 86 opposite end 84. End 86 has a central section 86*a* positioned between opposite end sections 86*b*, 86*c*. Section 86*a* includes a bottom surface 86*a*1 that engages wall 56 and an opposite top surface 86*a*2 that is positioned between wall 56 and a top surface 64*c* of wall 64. Sections 86*b*, 86*c* each extend above surface 64*c*, as shown in FIG. 4, for example. In some embodiments, end 86 is concavely curved between section 86*a* and section 86*b* and between section 86*a* and section 86*c* such that a portion of each of sections 86*b*, 86*c* are positioned above surface 64*c*. In some embodiments, section 86*a* is permanently fixed relative to wall 64 along an entire length of section 86*a*. That is, no part of section 86*a* is movable relative to wall 64.

Jacket 82 includes a side 88 positioned between end 86 and end 84. Side 88 has a central section 88*a* positioned between opposite end sections 88*b*, 88*c*. Section 88*a* includes a bottom surface 88*a*1 that engages wall 56 and an opposite top surface 88*a*2 that is positioned between wall 56 and a top surface 58*c* of wall 58. Sections 88*b*, 88*c* each extend above surface 58*c*, as shown in FIG. 6, for example. In some embodiments, side 88 is concavely curved between section 88*a* and section 88*b* and between section 88*a* and section 88*c* such that a portion of each of sections 88*b*, 88*c* are positioned above surface 58*c*. Sections 84*b*, 88*b* define a flap 90 that is movable relative to walls 58, 62 and extends above surfaces 58*c*, 62*c*. Sections 86*b*, 88*c* define a flap 92 that is movable relative to walls 58, 64 and extends above surfaces 58*c*, 64*c*. In some embodiments, section 88*a* is permanently fixed relative to wall 58 along an entire length of section 88*a*. That is, no part of section 88*a* is movable relative to wall 58.

Jacket 82 includes a side 94 positioned between end 86 and end 84. Side 94 is positioned opposite side 88. Side 94 has a central section 94*a* positioned between opposite end sections 94*b*, 94*c*. Section 94*a* includes a bottom surface 94*a*1 that engages wall 56 and an opposite top surface 94*a*2 that is positioned between wall 56 and a top surface 60*c* of wall 60. Sections 94*b*, 94*c* each extend above surface 60*c*, as shown in FIG. 4, for example. In some embodiments, side 94 is concavely curved between section 94*a* and section 94*b* and between section 94*a* and section 94*c* such that a portion of each of sections 94*b*, 94*c* are positioned above surface 60*c*. Sections 84*c*, 94*b* define a flap 96 that is movable relative to walls 58, 62 and extends above surfaces 58*c*, 62*c*. Sections 86*c*, 94*c* define a flap 98 that is movable relative to walls 60, 64 and extends above surfaces 60*c*, 64*c*. In some embodiments, section 94*a* is permanently fixed relative to wall 60 along an entire length of section 94*a*. That is, no part of section 94*a* is movable relative to wall 60.

Chassis 54 includes one or a plurality of fasteners, such as, for example, zippers to connect other components of mattress assembly 34 with chassis 54, as discussed herein. In some embodiments, chassis 54 includes a row of teeth 100 of a zipper 102. Teeth 100 extend along walls 58, 60, 62, 64 and are configured to engage and/or interdigitate with a row of teeth 104 of a component of system 30, such as, for example, a cover 106 to attach cover 106 to chassis 54, as discussed herein. Teeth 104 are part of zipper 102 and may be moved relative to teeth 100 using a slider of zipper 102 such that teeth 104 engage and/or interdigitate with teeth 100. In some embodiments, teeth 100 extend continuously about the entire perimeter of cavity 66. In some embodiments, teeth 100 are positioned at an interface between surfaces 58*a*, 58*c*, at an interface between surface 60*a*, 60*c*, at an interface between surfaces 62*a*, 62*c*, and at an interface between surfaces 64*a*, 64*c*. In some embodiments, cover 106 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, cover 106 includes a suspension fabric that covers coil packs 68*a*, 68*b*. Cover 106 may be formed from one or more of the materials discussed herein. In some embodiments, cover 106 comprises a breathable material that allows air and/or moisture to move in and outer of cavity 66 through cover 106. In some embodiments, cover 106 is highly porous. In some embodiments, cover 106 includes pores that are greater than 0.5 microns. In some embodiments, cover 106 includes pores that are greater than 3.0 microns. In some embodiments, cover 106 includes pores that are greater than 10.0 microns. In some embodiments, cover 106 has a porosity that is less than a porosity of walls 58, 60, 62, 64 such that air and/or moisture in cavity 66 will exit cavity 66 through walls 58, 60, 62, 64 instead of cover 106. That is, air and/or moisture in cavity 66 will move out of cavity 66 through walls 58, 60, 62, 64 before any air and/or moisture moves through cover 106. In some embodiments, cover 106 has a porosity that is greater than a porosity of walls 58, 60, 62, 64 such that air and/or moisture in cavity 66 will exit cavity through cover 106 instead of walls 58, 60, 62, 64. That is, air and/or moisture in cavity 66 will move out of cavity 66 through cover 106 before any air and/or moisture moves through walls 58, 60, 62, 64.

In some embodiments, chassis 54 includes one or a plurality of connectors, such as, for example, belts 148 and buckles 150, shown in FIG. 10A, that are configured to secure walls 58, 60, 62, 64 relative to one another and/or prevent movement of coil pack(s) 68 within cavity 66 relative to chassis 54. For example, in one embodiment, chassis 54 includes one or a plurality of belts 148*a* coupled to wall 62 and one or a plurality of buckles 150*a* coupled to wall 64. Buckle 150*a* includes a prong 150*a*1 configured for disposal in a hole 148*a*1 in belt 148*a* to draw wall 64 toward wall 62. In one embodiment, chassis 54 includes one or a plurality of belts 148*b* coupled to wall 64 and one or a plurality of buckles 150*b* coupled to wall 62. Buckle 150*b* includes a prong 150*b*1 configured for disposal in a hole 148*b*1 in belt 148*b* to draw wall 64 toward wall 62. In one embodiment, chassis 54 includes one or a plurality of belts 148*c* coupled to wall 58 and one or a plurality of buckles 150*c* coupled to wall 60. Buckle 150*c* includes a prong 150*c*1 configured for disposal in a hole 148*c*1 in belt 148*c* to draw wall 58 toward wall 60. In one embodiment, chassis 54 includes one or a plurality of belts 148*d* coupled to wall 60 and one or a plurality of buckles 150*d* coupled to wall 58. Buckle 150*d* includes a prong 150*d*1 configured for disposal in a hole 148*d*1 in belt 148*d* to draw wall 58 toward wall 60. It is envisioned that belts 148 and/or buckles 150 can include mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts in addition to or in place of the prongs and/or the openings, depending upon the requirements of a particular application.

In some embodiments, chassis 54 includes a row of teeth 108 of a zipper 110. Teeth 108 extend along walls 58, 60, 62, 64 and are configured to engage and/or interdigitate with a row of teeth 112 of a component of system 30, such as, for example, a comfort layer 114 to attach comfort layer 114 to chassis 54, as discussed herein. Teeth 112 are part of zipper 110 and may be moved relative to teeth 108 using a slider of zipper 110 such that teeth 112 engage and/or interdigitate with teeth 108. In some embodiments, teeth 108 extend continuously about the entire perimeter of teeth 100. That is, teeth 100 define a perimeter that is enclosed within a perimeter defined by teeth 108. In some embodiments, teeth 108 are positioned at an interface between surfaces 58*b*, 58*c*, at an interface between surfaces 60*b*, 60*c*, at an interface between surfaces 62*b*, 62*c*, and at an interface between surfaces 64*b*, 64*c*. In some embodiments, comfort layer 114 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

In some embodiments, comfort layer 114 is similar to a mattress topper and is configured to be positioned on top of cover 106 such that a bottom surface of comfort layer 114 directly engages a top surface of cover 106. In some embodiments, comfort layer 114 includes a cushion or cushioning material to provide cushioning to the sleeper(s) that lie on top of comfort layer 114. Comfort layer 114 is removeably coupled to chassis 54 to allow comfort layer 114 to be removed from chassis 54 for cleaning or to replace comfort layer 114 with a new comfort layer 114, as discussed herein. For example, if the sleeper desires a mattress that is firmer, comfort layer 114 can be removed from chassis 54 by unzipping zipper 110. Comfort layer 114 can then be replaced with a comfort layer 114 that is firmer. In some embodiments, comfort layer 114 can be a mat, a mattress topper or a mattress. It is envisioned that comfort layer 114 can have various thicknesses. For example, comfort layer 114 can have a thickness that is less than 1 inch, a thickness that is greater than 3 inches or any thickness between 0.1 inches and 12 inches.

In some embodiments, chassis 54 includes a row of teeth 116 of a zipper 118. Teeth 116 extend continuously along an upper edge of jacket 82 and are configured to engage and/or interdigitate with a row of teeth 120 of a component of system 30, such as, for example, a top cover 122 to attach cover 122 to chassis 54, as discussed herein. That is, teeth 116 extend along surfaces 84*a*2, 86*a*2, 88*a*2, 94*a*2 and upper edges of flaps 90, 92, 96, 98. Teeth 120 are part of zipper 118 and may be moved relative to teeth 116 using a slider of zipper 118 such that teeth 120 engage and/or interdigitate with teeth 116. In some embodiments, teeth 116 extend continuously about the entire perimeter of teeth 108. That is, teeth 108 define a perimeter that is enclosed within a perimeter defined by teeth 116. In some embodiments, teeth 116 extend continuously along an entire perimeter of jacket 82. Since jacket 82 is positioned outside of walls 58, 60, 62, 64, the perimeter defined by walls 58, 60, 62, 64 is enclosed within the perimeter defined by jacket 82. In some embodiments, cover 122 can be variously connected with chassis 54, such as, for example, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, teeth 120 include a start 120*a*, as shown in FIG. 15, and cover 122 includes a flap 125 that is configured to cover start 120*a* and a slider of zipper 118. In some embodiments, flap 125 includes a fastener, such as, for example, hooks and/or loops 125 of Velcro that is configured to attach to hooks and/or loops of chassis 54 to fix flap 125 relative to cover 122 and chassis 54.

Surface 36 is defined by a top surface of cover 122. Cover 122 is configured to couple comfort layer 114 to chassis 54 such that comfort layer 114 is prevented from shifting relative to chassis 54. Cover 122 includes a bottom surface 128 opposite surface 36. In some embodiments, cover 122 is made from a fabric material, such as, for example, a spandex material. That is, the fabric material of cover 122 defines a base material of cover 122. In some embodiments, cover 122 includes one or a plurality of straps 130 that are configured to provide strength to mattress assembly 34, as discussed herein. In some embodiments, one or more of straps 130 are defined by stitching that is stitched into the base material such that straps 130 define areas of reinforced stitching that limit the stretchability of the base material in at least one direction such that mattress assembly 34 is sturdy when assembled, as discussed herein.

In one embodiment, cover 122 includes at least one strap 130 that extends diagonally across cover 122, as shown in FIG. 13A. For example, in one embodiment, cover 122 includes a strap 130*a* that extends from a corner 132 of cover 122 to a corner 134 of cover 122 and/or a strap 130*b* that extends from a corner 136 of cover 122 to a corner 138 of cover 122. In some embodiments, cover 122 includes strap 130*a* and/or strap 130*b* and/or one or more additional diagonal straps 130. Straps 130*a*, 130*b* are configured to draw flap 90 toward flap 98 and/or draw flap 92 toward flap, or vice versa. For example, in some embodiments, straps 130*a*, 130*b* each have a maximum length that is less than the maximum length between flap 90 and flap 98 and a maximum length between flap 92 and flap 96 before cover 122 is zipped into chassis 54. Once cover 122 is zipped into chassis 54, the maximum length between flap 90 and flap 98 and the maximum length between flap 92 and flap 96 reduces such that the maximum length between flap 90 and flap 98 and the maximum length between flap 92 and flap 96 is equal to the maximum lengths of straps 130*a*, 130*b*.

In one embodiment, cover 122 includes at least one strap 130 that extends vertically across cover 122, as shown in FIG. 13B. For example, in one embodiment, cover 122 includes spaced apart straps 130*c*, 130*d*, 130*e* that each extend from an end 140 of cover 122 to an opposite end 142 of cover 122, in addition to or in place of strap 130*a*, strap 130*b* and/or any additional diagonal straps 130. In some embodiments, strap 130*d* is positioned equidistant between a side 144 of cover 122 and an opposite side 146 of cover 122; strap 130*c* is positioned equidistant between side 144 and strap 130*d*; and strap 130*e* is positioned equidistant between side 146 and strap 130*d*. In some embodiments, strap 130*c* is closer to one of side 144 or strap 130*d* than the other one of side 144 or strap 130*d* and/or strap 130*e* is closer to one of side 146 or strap 130*d* than the other one of side 146 or strap 130*d*. In some embodiments, cover 122 includes strap 130*c*, strap 130*d* and/or strap 130*e* and/or one or more additional vertical straps 130. Straps 130*c*, 130*d*, 130*d* are configured to draw wall 62 toward wall 64, or vice versa. For example, in some embodiments, straps 130*c*, 130*d*, 130*d* each have a maximum length that is less than the maximum length between wall 62 and wall 64 before cover 122 is zipped into chassis 54. Once cover 122 is zipped into chassis 54, the maximum length between wall 62 and wall 64 is equal to the maximum lengths of straps 130*c*, 130*d*, 130*d*.

In one embodiment, cover 122 includes at least one strap 130 that extends horizontally across cover 122. For example, in one embodiment, cover 122 includes spaced apart straps 130*f*, 130*g*, 130*h* that each extend from end 140 to end 142, as shown in FIG. 13C, in addition to or in place of strap 130*a*, strap 130*b*, strap 130*c*, strap 130*d* and/or strap 130*e*. In some embodiments, strap 130*g* is positioned equidistant between end 140 and end 142; strap 130*f* is positioned equidistant between end 140 and strap 130*g*; and strap 130*h* is positioned equidistant between end 142 and strap 130*g*. In some embodiments, strap 130*f* is closer to one of end 140 or strap 140*g* than the other one of end 140 or strap 130*g* and/or strap 130*h* is closer to one of end 142 or strap 130*g* than the other one of end 142 or strap 130*g*. In some embodiments, cover 122 includes strap 130*e*, strap 130*f* and/or strap 130*g* and/or one or more additional horizontal straps 130. Straps 130*e*, 130*f*, 130*g* are configured to draw wall 58 toward wall 60, or vice versa. For example, in some embodiments, straps 130*e*, 130*f*, 130*g* each have a maximum width that is less than the maximum width between wall 58 and wall 60 before cover 122 is zipped into chassis 54. Once cover 122 is zipped into chassis 54, the maximum width between wall 58 and wall 60 is equal to the maximum widths of straps 130*e*, 130*f*, 130*g*.

As discussed above, one or a plurality of coil packs 68 is/are configured for disposal within cavity 66. For example, mattress assembly 34 may include a first coil pack 68*a* and a second coil pack 68*b*. In some embodiments, coil pack 68*a* is different than coil pack 68*b*. For example, in one embodiment, coil pack 68*a* has a firmness that is different than a firmness of coil pack 68*b*. This allows mattress assembly 34 to accommodate two different comfort preferences of two different sleepers. For example, if a sleeper who sleeps on the left side of the bed prefers a firmer mattress than a sleeper who sleeps on the right side of the bed, coil pack 68*a* can be provided with a firmness that is greater than a firmness of coil pack 68*b*. If, on the other hand, the sleeper who sleeps on the left side of the bed prefers a softer mattress than the sleeper who sleeps on the right side of the bed, coil pack 68*a* can be provided with a firmness that is less than a firmness of coil pack 68*b*. In some embodiments, springs 124 of coil pack 68*a* may include more or less coils than springs 124 of coil pack 68*b*. In some embodiments, springs 124 of coil pack 68*a* may include coils having a different gauge than the coils of springs 124 of coil pack 68*b*. In some embodiments, springs 124 of coil pack 68*a* may include different coils than the coils of springs 124 of coil pack 68*b*. For example, springs 124 of coil pack 68*a* may include continuous coils, bonnell coils, offset coils and marshall coils and coil pack 68*b* may include springs 124 having coils that are different than the coils of springs 124 of coil pack 68*a*. Using different springs 124 in coil pack 68*a* than coil pack 68*b* allows mattress assembly 34 to be customized based on preference. It is also envisioned that coil pack 68*a* and coil pack 68*b* can be identical to one another in both structure and performance.

In some embodiments, coil packs 68*a* 68*b* are positioned directly on top of wall 56 such that bottom surfaces of coil packs 68*a* 68*b* directly engage surface 56*a* of wall 56. When coil packs 68*a* 68*b* are positioned within cavity 66, surfaces of coil pack 68*a* directly engage surfaces 58*a*, 62*a*, 64*a*, surfaces of coil pack 68*b* directly engage surfaces 60*a*, 62*a*, 64*a* and a side surface of coil pack 68*a* directly engages a side surface of coil pack 68 to prevent coil packs 68*a*, 68*b* from moving relative to one another and chassis 54.

Coil pack 68*a* and coil pack 68*b* each comprise a plurality of springs 124 positioned within a pouch 126, as shown in FIGS. 5A and 5B, for example. Springs 124 are enclosed within pouch 126. Coil packs 68*a*, 68*b* each comprise one or a plurality of rows of springs 124 and one or a plurality of columns of springs 124. As shown in FIG. 5B, coil packs 68*a*, 68*b* each include a plurality of rows of springs 124 and a plurality of columns of springs 124. In some embodiments, coil packs 68*a*, 68*b* each include a plurality of strings of springs, as described in U.S. Patent Application No. 62/347,199 to the applicant of the current application, which is incorporated by reference herein, in its entirety. In some embodiments, springs 124 are each positioned within a pocket, such as, for example, a fabric pocket. The pockets may be coupled to one another to form a string of pockets that each include one of springs 124 therein. In some embodiments, the string of pockets includes one or more slits between adjacent pockets to allow springs 124 to move independently of one another. In some embodiments, the string of pockets includes one or more slits that extend through a top surface of the string of pockets between adjacent pockets and/or one or more slits that extend through a bottom surface of the string of pockets between adjacent pockets.

In operation and use, the components of mattress assembly 34 may be shipped to a destination, such as, for example, a residential home, in one or a plurality of containers, such as, for example, one or a plurality of boxes 152. It is envisioned that the components of mattress assembly 34 may be shipped to the destination via ground shipping. In some embodiments, the components of mattress assembly 34 are shipped to the destination via the U.S. postal system, United Parcel Service or Federal Express. In some embodiments, chassis 54 and cover 122 are packaged in a first box 152*a*, comfort layer 114 is packaged in a second box 152*b* that is separate from box 152*a*, a first coil pack 68 is packaged in a third box 152*c* that is separate from boxes 152*a*, 152*b*, and a second coil pack 68 is packaged in a fourth box 152*d* that is separate from boxes 152*a*, 152*b*, 152*c*, as shown in FIG. 19. In some embodiments, a set of instructions 154 may be included in one of boxes 152*a*, 152*b*, 152*c*, 152*d* that includes step by step directions how to assemble mattress assembly 34.

In some embodiments, instructions 154 include an overview of what is included in boxes 152*a*, 152*b*, 152*c*, 152*d*, as shown in FIG. 20. In some embodiments, instructions 154 include directions for removing chassis 54 from box 152*a* and assembling chassis 54, as shown in FIG. 21. For example, in some embodiments, chassis 54 is removed from box 152*a* with chassis 54 in a folded and compressed configuration. Chassis 54 is removed from an outer plastic sleeve and is unfolded. Chassis 54 is then removed from an inner plastic cover to decompress chassis 54. In some embodiments, chassis 54 is removed from the outer plastic sleeve using a cutting tool. In some embodiments, the cutting tool is included in one of boxes 152*a*, 152*b*, 152*c*, 152*d*.

In some embodiments, instructions 154 include directions for removing coil packs 68 from boxes 152*c*, 154*d* and assembling coil packs 68 with chassis 54, as shown in FIG. 22. For example, in some embodiments, the first coil pack 68 is removed from box 152*c* with the first coil pack 68 in a rolled and compressed configuration. The first coil pack 68 is then removed from an outer plastic sleeve and unrolled. The first coil pack 68 is then removed from an inner plastic cover to decompress the first coil pack 68. Once the first coil pack 68 is decompressed, the first coil pack 68 is inserted into cavity 66. Likewise, the second coil pack 68 is removed from box 152*d* with the second coil pack 68 in a rolled and compressed configuration. The second coil pack 68 is then removed from an outer plastic sleeve and unrolled. The second coil pack 68 is then removed from an inner plastic cover to decompress the second coil pack 68. Once the second coil pack 68 is decompressed, the second coil pack 68 is inserted into cavity 66 and is positioned next to the first coil pack 58. In some embodiments, the coil packs 68 are removed from the outer plastic sleeve using the cutting tool that was used to remove chassis 54 from the outer plastic sleeve. Cover 106 is positioned over coil packs 68 such that teeth 100 of zipper 102 engage teeth 104 of zipper 102. Zipper 102 is then zipped up such that teeth 100 interdigitate with teeth 104 to attach cover 106 with chassis 54, as discussed herein.

In some embodiments, instructions 154 include directions for removing comfort layer 114 from box 152*b* and assembling comfort layer 114 with chassis 54, as shown in FIG. 23. For example, in some embodiments, comfort layer 114 is removed from box 152*b* with comfort layer 114 in a rolled and compressed configuration. Comfort layer 114 is removed from an outer plastic sleeve using the cutting tool and is unrolled. Comfort layer 114 is then removed from an inner plastic cover to decompress comfort layer 114. Once comfort layer 114 is decompressed, comfort layer 114 is positioned on top of cover 106 such that teeth 108 of zipper 110 engage teeth 112 of zipper 110. Zipper 110 is then zipped up such that teeth 108 interdigitate with teeth 112 to attach comfort layer 114 with chassis 54, as discussed herein.

In some embodiments, instructions 154 include directions for removing cover 122 from box 152*a* and assembling cover 122 with chassis 54, as shown in FIG. 24. For example, in some embodiments, cover 122 is moved from a rolled configuration to an unrolled configuration and is laid over comfort layer 114 such that teeth 116 of zipper 118 engage teeth 120 of zipper 118. Zipper 118 is then zipped up such that teeth 116 interdigitate with teeth 120 to attach comfort cover 122 with chassis 54, as discussed herein.

In some embodiments, a kit is provided that includes one or more of the components of bedding system 30 discussed herein. For example, the kit may include one or more chassis, such as, for example, chassis 54 discussed herein. It is envisioned that the chassis of the kit may vary with respect to size, shape and/or material. The kit may include one or more first cover, such as, for example, cover 106 and one or more second cover, such as, for example, cover 122 discussed herein. It is envisioned that the covers of the kit may vary with respect to size, shape and/or material. For example, the covers may include different fill materials and/or may have different firmnesses. The kit may include one or more comfort layer, such as, for example, comfort layer 114 discussed herein. It is envisioned that the comfort layers of the kit may vary with respect to size, shape and/or material. The kit may include one or more coil pack, such as, for example, coil pack 68 discussed herein. It is envisioned that the coil packs of the kit may vary with respect to size, shape and/or material. For example, the coil packs may include a plurality of coil packs having different firmnesses. In some embodiments, the kit includes other bedding items. For example, the kit may include a foundation, bed sheets, pillows, pillow cases, a blanket or comforter, etc.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A method for assembling a mattress having a form, the method comprising:

positioning a coil pack in a cavity of a chassis, the chassis comprising a bottom wall, opposite first and second side walls extending upwardly from the bottom wall and opposite first and second end walls extending upwardly from the bottom wall, the walls defining a cavity, the coil pack comprising a plurality of springs;

positioning a first cover positioned over the coil pack and attaching the first cover to the chassis with a first zipper at a first point of the chassis;

positioning a comfort layer over the first cover and attaching the comfort layer to the chassis using a second zipper at a second point of the chassis; and positioning a second cover over the comfort layer and attaching the second cover to the chassis using a third zipper at a third point of the chassis, wherein the chassis accepts the zippers at the points to establish the form and mitigate the chassis, the coil pack, the first and second covers and the comfort layer from shifting.

2. The method recited in claim 1, further comprising:

removing the chassis from a container with the chassis in a folded and compressed configuration;

removing the chassis from an outer plastic sleeve;

unfolding the chassis; and removing the chassis from an inner plastic cover to decompress the chassis.

3. The method recited in claim 2, wherein the chassis is removed from the outer plastic sleeve using a cutting tool.

4. The method recited in claim 1, further comprising:

removing the coil pack from a container with the coil pack in a rolled and compressed configuration;

removing the coil pack from an outer plastic sleeve;

unrolling the coil pack; and removing the coil pack from an inner plastic cover to decompress the coil pack.

5. The method recited in claim 4, wherein the coil pack is removed from the outer plastic sleeve using a cutting tool.

6. The method recited in claim 4, wherein removing the coil pack from the inner plastic cover comprises making an incision in the inner plastic cover.

7. The method recited in claim 1, further comprising:

removing the comfort layer from a container with the comfort layer in a rolled and compressed configuration;

removing the comfort layer from an outer plastic sleeve;

unrolling the comfort layer; and removing the comfort layer from an inner plastic cover to decompress the comfort layer.

8. The method recited in claim 7, wherein the comfort layer is removed from the outer plastic sleeve using a cutting tool.

9. The method recited in claim 7, wherein removing the comfort layer from the inner plastic cover comprises piercing the inner plastic cover.

10. The method recited in claim 1, wherein:

the first cover comprises a first row of teeth of the first zipper and the chassis comprises a second row of teeth of the first zipper; and attaching the first cover to the chassis comprises interdigitating the first row of teeth with the second row of teeth.

11. The method recited in claim 1, wherein:

the comfort layer comprises a first row of teeth of the second zipper and the chassis comprises a second row of teeth of the second zipper; and attaching the comfort layer to the chassis comprises interdigitating the first row of teeth with the second row of teeth.

12. The method recited in claim 1, wherein:

the comfort layer comprises a first row of teeth of the second zipper and the chassis comprises a second row of teeth of the second zipper; and attaching the comfort layer to the chassis comprises interdigitating the first row of teeth with the second row of teeth.

13. The method recited in claim 1, wherein:

the second cover comprises a first row of teeth of the third zipper and the chassis comprises a second row of teeth of the third zipper; and attaching the second cover to the chassis comprises interdigitating the first row of teeth with the second row of teeth.

14. The method recited in claim 1, further comprising:

providing instructions that include directions how to assemble the mattress; and assembling the mattress using the instructions.

15. The method recited in claim 1, further comprising:

providing instructions that include step by step directions how to assemble the mattress; and assembling the mattress using the instructions.

16. The method recited in claim 2, further comprising:

providing instructions that include step by step directions how to assemble the mattress, the directions including instructions how to remove the chassis from the container, instructions how to remove the chassis from the outer plastic sleeve, instructions how to unfold the chassis, and instructions how to remove the chassis from the inner plastic cover; and assembling the mattress using the instructions.

17. The method recited in claim 4, further comprising:

providing instructions that include step by step directions how to assemble the mattress, the directions including instructions how to remove the coil pack from the container, instructions how to remove the coil pack from the outer plastic sleeve, instructions how to unroll the coil pack, and instructions how to remove the coil pack from the inner plastic cover; and assembling the mattress using the instructions.

18. The method recited in claim 7, further comprising:

providing instructions that include step by step directions how to assemble the mattress, the directions including instructions how to remove the comfort layer from the container, instructions how to remove the comfort layer from the outer plastic sleeve, instructions how to unroll the comfort layer, and instructions how to remove the comfort layer from the inner plastic cover; and assembling the mattress using the instructions.

19. The method recited in claim 1, further comprising:

removing the second cover from a container with the second cover in a rolled configuration; and unrolling the second cover.

20. The method recited in claim 19, further comprising:

providing instructions that include step by step directions how to assemble the mattress, the directions including instructions how to remove the second cover from the container and instructions how to unroll the second cover; and assembling the mattress using the instructions.

* * * * *